US005415988A

United States Patent [19]

Ohki et al.

[11] Patent Number: 5,415,988

[45] Date of Patent: May 16, 1995

[54] SILVER HALIDE COLOR PHOTOGRAPHIC LIGHT-SENSITIVE MATERIAL

[75] Inventors: Nobutaka Ohki; Osamu Takahashi, both of Kanagawa, Japan

[73] Assignee: Fuji Photo Film Co., Ltd., Kanagawa, Japan

[21] Appl. No.: 155,561

[22] Filed: Nov. 22, 1993

[30] Foreign Application Priority Data

Nov. 25, 1992 [JP] Japan ..... 4-338052

[51] Int. Cl.[6] ..... G03C 1/33; G03C 7/38; G03C 1/76

[52] U.S. Cl. ..... 430/551; 430/558

[58] Field of Search ..... 430/551, 558, 546

[56] References Cited

U.S. PATENT DOCUMENTS 3,700,453 10/1972 Knechel .
4,963,466 10/1990 Kajiwara et al. ..... 430/551
4,988,613 1/1991 Ohki et al. .
5,208,140 5/1993 Nishijima ..... 430/551

FOREIGN PATENT DOCUMENTS

0459331A1 12/1991 European Pat. Off. .
51-12250 4/1976 Japan .

*Primary Examiner*—Lee C. Wright
*Attorney, Agent, or Firm*—Birch, Stewart, Kolasch & Birch

[57] ABSTRACT

A silver halide color photographic light-sensitive material having a support which has thereon at least one light-sensitive silver halide emulsion layer and at least one light-nonsensitive layer, wherein the light-nonsensitive layer comprises a layer which contains a compound represented by formula (I) and a compound represented by formula (II), the light-sensitive silver halide emulsion layer comprises at least one coupler represented by formula (III), and a total amount of a compound represented by formula (II) is 2 to 20 mol % of a total amount of a compound represented by formula (I).

(I)

(II)

(III)

20 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, and more particularly to a silver halide color photographic light-sensitive material which has excellent spectral characteristics, provides improved blank white areas and gradation, and provides reduced deterioration of processing solutions in which the material is processed even under continuous processing.

BACKGROUND OF THE INVENTION

Silver halide color photographic light-sensitive materials have a structure in which light-sensitive emulsion layers comprised of three kinds of silver halide emulsion layers which are selectively sensitized with red, green and blue light, respectively, are multilayered and are coated onto a support. For instance, color photographic printing papers (hereinafter referred to as color papers) generally have red sensitive, green sensitive and blue sensitive emulsion layers on a support in this order as viewed from the side which is exposed, with intermediate layers, protective layers or the like provided between the respective light-sensitive layers for inhibiting color mixing cross talk and for absorbing ultraviolet rays. Moreover, so-called color positive films have green sensitive, red sensitive and blue sensitive emulsion layers applied on a support in this order as viewed from the side remote from the support, namely, from the side which is exposed. Color negative films have various layer arrangements, and generally have blue sensitive, green sensitive and red sensitive emulsion layers in this order from the exposed side. However, light-sensitive materials having two or more emulsion layers which are sensitive to the same color light with different sensitivity levels sometimes have other emulsion layers having a different color sensitivity between any two of the layers. For example, yellow filters which are capable of being bleached and other intermediate layers are sometimes inserted between the emulsion layers, and protective layers are sometimes formed on the outermost layer.

In order to form color photographic images, a light-sensitive material having light-sensitive emulsion layers containing photographic couplers corresponding to the three colors, i.e., yellow, magenta and cyan, is exposed to light, and the exposed light-sensitive material is subjected to color developing processing by so-called color developing agents.

The thus formed color dyes are required to be bright yellow, magenta and cyan dyes having reduced subsidiary absorption, and to provide color photographic images having excellent color reproduction.

Color dyes which are formed by 5-pyrazolone type magenta couplers widely employed for forming magenta dyes have a subsidiary absorption in the vicinity of 430 nm beside the main absorption in the vicinity of 550 nm. Therefore, various studies have been conducted for solving this drawback of subsidiary absorption.

Among such studies, U.S. Pat. Nos. 3,061,432, 4,540,654 and 4,500,630, and JP-B-47-27411, JP-A-60-33552, JP-A-60-43659, and Research Disclosure No. 24626 disclose pyrazoloazole type magenta couplers which are capable of providing dyes having excellent spectral absorption characteristics with reduced subsidiary absorption. (Note that the term "JP-A" refers to an unexamined, published Japanese patent application, and "JP-B" refers to an examined, published Japanese patent application.)

However, these pyrazoloazole type couplers are disadvantageous in so far as gradation in a low density part of the images, which is called "toe part gradation", is difficult to control. This has hindered the introduction of couplers of this type into products. In order to improve the toe part gradation of pyrazoloazole type couplers, U.S. Pat. No. 4,988,613, EP-A-0 459 331 A1 and the like propose using pyrazoloazole type couplers together with gradation improving agent. However, the effects are not necessarily satisfactory, and there are adverse side effects such as unstable photographic performance during storage, deterioration of processing solutions under continuous processing, and the like.

SUMMARY OF THE INVENTION

An object of the present invention is to provide a silver halide color photographic light-sensitive material which has excellent spectral characteristics, provides excellent blank white areas and gradation, maintains a stable photographic performance during storage and provides reduced deterioration to processing solutions in which the material is processed even under continuous processing.

It has been found that these and other objects can be achieved by a silver halide color photographic light-sensitive material having a support which has thereon at least one light-sensitive silver halide emulsion layer and at least one light-nonsensitive layer, wherein said light-nonsensitive layer comprises a layer which contains a compound represented by formula (I) and a compound represented by formula (II), said light-sensitive silver halide emulsion layer comprises at least one coupler represented by formula (III), and a total amount of a compound represented by formula (II) is 2 to 20 mol % of a total amount of a compound represented by formula (I):

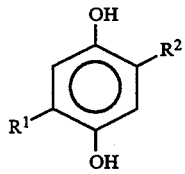

(I)

wherein $R^1$ and $R^2$ independently represent an alkyl group, a sum of carbon atoms of $R^1$ and $R^2$ being not less than 20 and not more than 40;

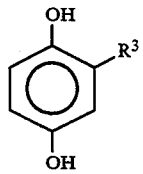

(II)

wherein $R^3$ represents an alkyl group having not less than 10 and not more than 20 carbon atoms;

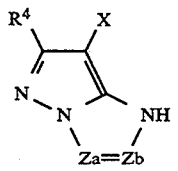

(III)

wherein Za and Zb independently represent $=C(R^5)-$ or $=N-$; $R^4$ and $R^5$ independently represent a substituent; and X represents a hydrogen atom or a releasable group in a reaction with an oxidation product of an aromatic primary amine color developing agent.

DETAILED DESCRIPTION OF THE INVENTION

The compounds represented by formula (I) according to the present invention generally function as color mixing inhibitors, but they hardly improve the quality of the blank white areas. The compounds represented by formula (II) are known to be effective as gradation improving agents which improve blank white areas and gradation, but when they are incorporated in emulsion layers, no particular superiority is found over the above-mentioned prior art. In view of the above situation, the present inventors have conducted earnest studies, and have found that light-sensitive materials utilizing the coupler of formula (III) can provide greatly improved blank white areas and gradation with excellent spectral absorption when the compound of formula (II) and the compound of formula (I) are incorporated together in a specified proportion into the light-nonsensitive layer. These effects have been obtained quite unexpectedly. Moreover, it has also been found that the preservability of the light-sensitive materials and the performance of the processing solutions are scarcely affected.

Furthermore, it has been found that when the coupler represented by formula (III) employed in the silver halide color photographic light-sensitive material has a group $-C(R^6)(R^7)(R^8)$ for $R^4$, namely, when it is a coupler represented by formula (IV), even greater effects can be obtained in improving the blank white areas and in controlling gradation and photographic performance during storage.

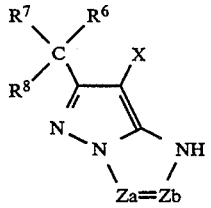

(IV)

wherein Za and Zb independently represent $=C(R^5)\geqq$ or $=N-$; $R^5$, $R^6$, $R^7$ and $R^8$ each represents a substituent; X represents a hydrogen atom or a releasable group in a coupling reaction with an oxidation product of a color developing agent.

The compounds of formulae (I) and (II) are now explained in detail.

In the formulae, $R^1$, $R^2$ and $R^3$ each represents an alkyl group. The sum of the carbon atoms of $R^1$ and $R^2$ is not less than 20 and not more than 40, and is preferably from 24 to 36. Examples of $R^1$ and $R^2$ include a methyl group, an ethyl group, a t-butyl group, a t-hexyl group, a t-octyl group, a t-decyl group, a sec-dodecyl group, a sec-tetradecyl group, a 2,6,10-trimethyl-2-dodecyl group, a sec-hexadecyl group, a 7-methyl-7-pentadecyl group, and a sec-octadecyl group. $R^3$ has 10 to 20 carbon atoms, and examples of $R^3$ include a t-decyl group, a sec-dodecyl group, a sec-tetradecyl group, a 2,6,10-trimethyl-2-dodecyl group, a sec-hexadecyl group, a 7-methyl-7-pentadecyl group and a sec-octadecyl group. $R^1$, $R^2$ and $R^3$ may independently be substituted by any group such as a halogen atom (such as fluorine, chlorine and bromine), a cyano group, a hydroxyl group, an alkoxy group (such as methoxy and butoxy), an aryloxy group (such as phenoxy), an alkylthio group (such as methylthio and butylthio), an arylthio group (such as phenylthio), an amide group (such as acetamide and benzamide), an alkoxycarbonyl group (such as hexyloxycarbonyl), an alkoxycarbonyloxy group (such as hexyloxycarbonyloxy), an acyl group (such as acetyl) and a sulfonyl group (such as benzenesulfonyl).

It is preferable that $R^1$ is a methyl group or that $R^1$ and $R^2$ are the same alkyl group; of the two, it is more preferable that $R^1$ and $R^2$ are the same alkyl group. Most preferably, $R^1$ and $R^2$ are both the same sec-alkyl group.

$R^3$ has preferably 12 to 20, more preferably 14 to 20, and still more preferably 14 to 18 carbon atoms.

Preferable examples of substituents for $R^1$, $R^2$ and $R^3$ include those mentioned above, among which a halogen atom, a hydroxyl group and an alkoxycarbonyl group are more preferable. However, a case in which $R^1$, $R^2$ an $R^3$ have no substituents is most preferable.

It is preferable that the compounds represented by formula (I) be incorporated in amounts of $1\times10^{-8}$ to $1\times10^{-2}$ mol/m$^2$, preferably $1\times10^{-7}$ to $1\times10^{-3}$ mol/m$^2$, and most preferably $1\times10^{-6}$ to $1\times10^{-4}$ mol/m$^2$.

The molar ratio of compounds of formula (II) to compounds of formula (I) is 2 to 20 mol %, preferably 2 to 15 mol %, more preferably 3 to 12 mol %, and most preferably 4 to 12 mol %.

Specific examples of hydroquinone derivatives represented by formulae (I) and (II) are described below, but the present invention is not restricted thereto.

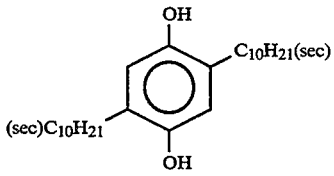

(I-1)

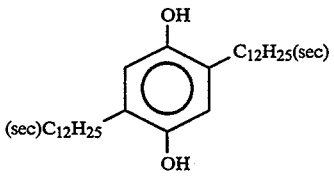

(I-2)

-continued
(I-3)
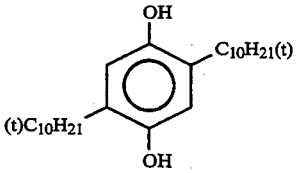
(I-4)
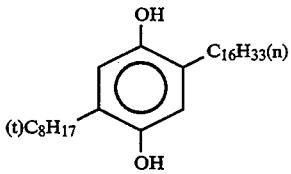
(I-5)
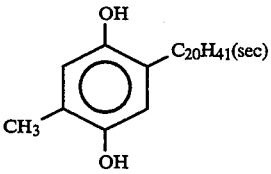
(I-6)
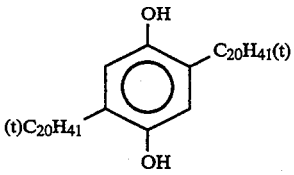
(I-7)
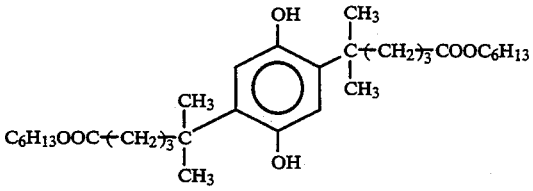
(I-8)
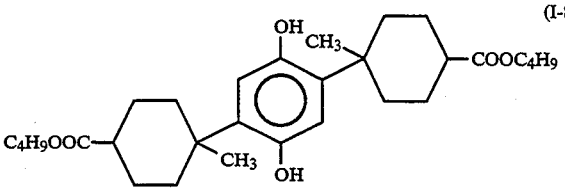
(I-9)
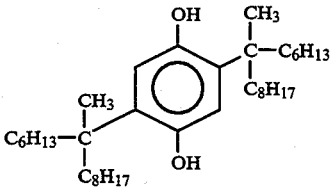
(I-10)
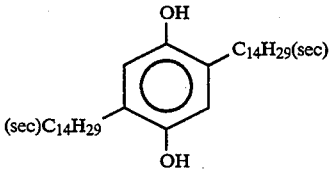
(I-11)
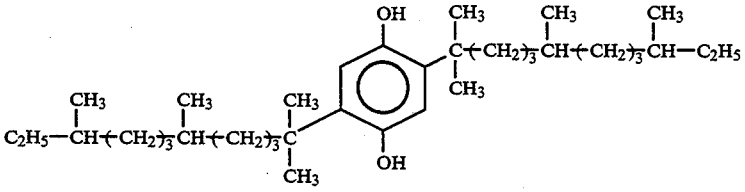
(I-12)
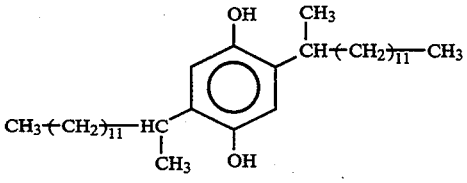
(I-13)
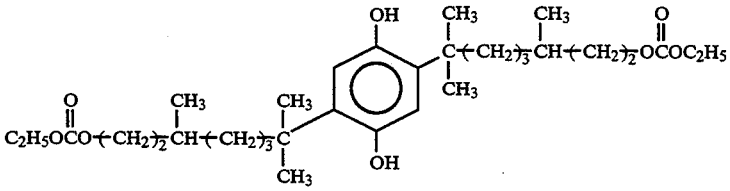
(I-14)
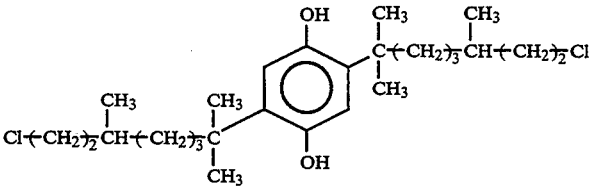

-continued (I-15)

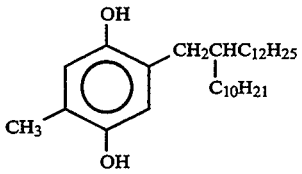

(II-1)

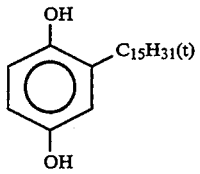

(II-2)

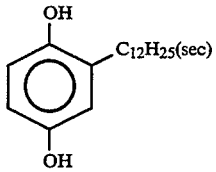

(II-3)

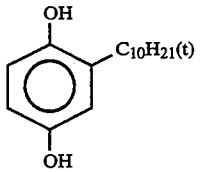

(II-4)

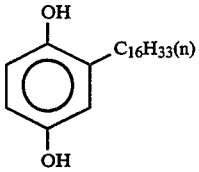

(II-5)

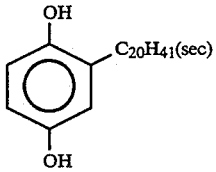

(II-6)

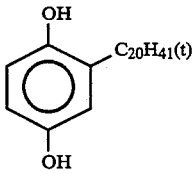

(II-7)

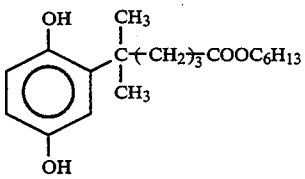

(II-8)

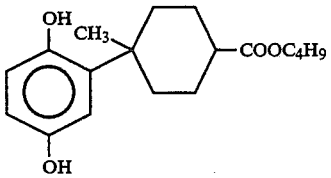

(II-9)

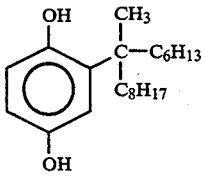

(II-10)

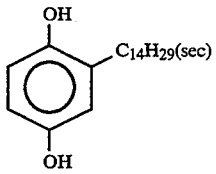

(II-11)

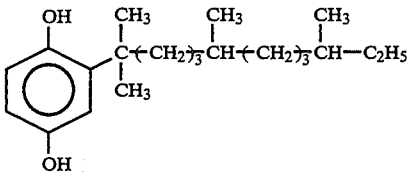

(II-12)

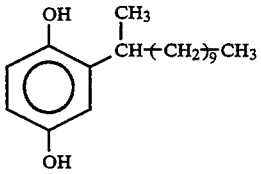

(II-13)

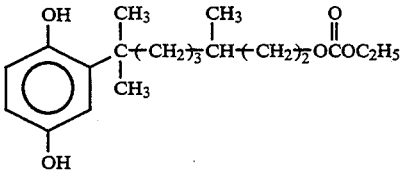

(II-14)

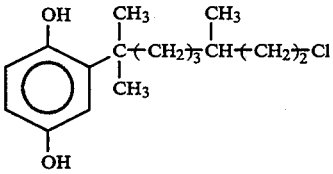

(II-15)

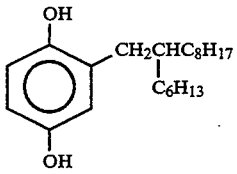

The compounds of formulae (I) and (II) of the present invention can be synthesized according to the methods described in JP-B-51-12250, JP-B-61-13748, JP-A-57-22237, JP-A-58-21249, JP-A-58-156932, JP-A-59-5247, and the like.

The compounds of formulae (III) and (IV) are now described in detail.

In the formulae, Za and Zb each independently represents $=C(R^5)-$ or $=N-$. $R^4$, $R^5$, $R^6$, $R^7$ and $R^8$ each independently represents a substituent, examples of which include a halogen atom, an aliphatic group, an aryl group, a heterocyclic group, a cyano group, a hydroxyl group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclicoxy group, an azo group, an acyloxy group, a carbamoyloxy group, a silyloxy group, an aryloxy carbonylamino group, an imido group, a heterocyclicthio group, a sulfinyl group, a phosphonyl group, an aryloxycarbonyl group, an acyl group and an azolyl group. Of these groups, those capable of having a substituent may optionally be substituted by any of the above described substituents.

In more detail, $R^4$, $R^5$, $R^6$, $R^7$ and $R^8$ each independently represents a substituent, examples of which include a halogen atom (for example, chlorine and bromine), an aliphatic group (for example, C1 to C32 linear or branched alkyl, aralkyl, alkenyl, alkynyl, cycloalkyl and cycloalkenyl, and more specifically, such as methyl, ethyl, propyl, isopropyl, tert-butyl, tridecyl, 2-methanesulfonylethyl, 3-(3-pentadecylphenoxy)propyl, 3-{4-{2-[4-(4-hydroxyphenylsulfonyl)phenoxy]-dodecanamide{phenyl{propyl, 2-ethoxytridecyl, trifluoromethyl, cyclopentyl and 3-(2,4-di-tert-amylphenoxy)propyl), an aryl group of preferably $C_6$ to $C_{56}$ (for example, phenyl, 4-tert-butylphenyl, 2,4-di-tert-amylphenyl, 2,4,6-trimethylphenyl, 3-tridecanamide-2,4,6-trimethylphenyl, 4-tetradecanamidephenyl and tetrafluorophenyl), a heterocyclic group of preferably $C_0$ to $C_{56}$ (for example, 2-furyl, 2-thienyl, 2-pirymidinyl and 2-benzothiazolyl), a cyano group, a hydroxyl group, a nitro group, a carboxy group, a sulfo group, an amino group, an alkoxy group of preferably $C_1$ to $C_{36}$ (for example, methoxy, ethoxy, 2-methoxyethoxy, 2-dodecylethoxy and 2-methanesulfonylethoxy), an aryloxy group of preferably $C_6$ to $C_{56}$ (for example, phenoxy, 2-methylphenoxy, 4-tert-butylphenoxy, 3-nitrophenoxy, 3-tert-butoxycarbamoylphenoxy and 3-methoxycarbamoylphenoxy), an acylamino group of preferably C2 to $C_{36}$ (for example, acetamide, benzamide, tetradecanamide, 2-(2,4-di-tert-amylphenoxy)-butanamide, 4-(3-tert-butyl-4-hydroxyphenoxy)butanamide and 2-[4-(4-hydroxyphenylsulfonyl)phenoxy]-decanamide), an alkylamino group of preferably $C_1$ to $C_{36}$ (for example, methylamino, butylamino, dodecylamino, diethylamino and methylbutylamino), an anilino group of preferably $C_6$ to $C_{56}$ (for example, phenylamino, 2-chloroanilino, 2-chloro-5-tetradecanaminoanilino, 2-chloro-5-dodecyloxycarbonylanilino, N-acetylanilino and 2-chloro-5-[2-(3-tert-butyl-4-hydroxyphenoxy)dodecanamide]anilino), a carbamoyl amino group of preferably $C_1$ to $C_{56}$ (for example, N-phenylcarbamoylamino, N-methylcarbamoylamino and N,N-dibutylcarbamoylamino), a sulfamoylamino group of preferably $C_1$ to $C_{56}$ (for example, N,N-dipropylsulfamoylamino and N-methyl-N-decylsulfamoylamino), an alkylthio group of preferably $C_1$ to $C_{36}$ (for example, methylthio, octylthio, tetradecylthio, 2-phenoxyethylthio, 3-phenoxypropylthio and 3-(4-tert-butylphenoxy)propylthio), an arylthio group of preferably $C_6$ to $C_{56}$ (for example, phenylthio, 2-butoxy-5-tert-octylphenylthio, 3-pentadecylphenylthio, 2-carboxyphenylthio and 4-tetradecanamidephenylthio), an alkoxycarbonylamino group of preferably $C_2$ to $C_{36}$ (for example, methoxycarbonylamino and tetradecyloxycarbonylamino), a sulfonamide group of preferably $C_1$ to $C_{56}$ (for example, methanesulfonamide, hexadecanesulfonamide, benzenesulfonamide, p-toluenesulfonamide, octadecanesulfonamide and 2-methoxy-5-tert-butylbenzenesulfonamide), a carbamoyl group of preferably $C_1$ to $C_{56}$ (for example, N-ethylcarbamoyl, N,N-dibutylcarbamoyl, N-(2-dodecyloxyethyl)carbamoyl, N-methyl-N-dodecylcarbamoyl and N-[3-(2,4-di-tert-amylphenoxy)propyl]carbamoyl), a sulfamoyl group of preferably $C_0$ to $C_{56}$ (for example, N-ethylsulfamoyl, N,N-dipropylsulfamoyl, N-(2-dodecyloxyethyl)sulfamoyl, N-ethyl-N-dodecylsulfamoyl and N,N-diethylsulfamoyl), a sulfonyl group of preferably $C_1$ to $C_{56}$ (for example, methanesulfonyl, octanesulfonyl, benzenesulfonyl and toluenesulfonyl), an alkoxycarbonyl group of preferably C2 to $C_{36}$ (for example, methoxycarbonyl, butoxycarbonyl, dodecyloxycarbonyl and octadecyloxycarbonyl), a heterocyclicoxy group of preferably $C_0$ to $C_{56}$ (for example, 1-phenyltetrazol-5-oxy and 2-tetrahydropiranyloxy), an azo group of preferably $C_6$ to $C_{56}$ (for example, phenylazo, 4-methoxyphenylazo, 4-pivaloylaminophenylazo and 2-hydroxy-4-propanoylphenylazo), an acyloxy group of preferably $C_2$ to $C_{56}$ (for example, acetoxy), a carbamoyloxy group of preferably $C_1$ to $C_{56}$ (for example, N-methylcarbamoyloxy and N-phenylcarbamoyloxy), a silyloxy group of preferably $C_2$ to $C_{36}$ (for example, trimethylsilyloxy and dibutylsilyloxy), an aryloxy carbonylamino group of preferably $C_7$ to $C_{57}$ (for example, phenoxycarbonylamino), an imido group of preferably $C_1$ to $C_{36}$ (for example, N-succinimide, N-phthalimide and 3-octadecenylsuccinimide), a heterocyclicthio group of preferably $C_1$ to $C_{56}$ (for example, 2-benzothiazolylthio, 2,4-di-phenoxy-1,3,5-triazole-6-thio and 2-pyridylthio), a sulfinyl group of preferably $C_1$ to $C_{56}$ (for example, dodecanesulfinyl, 3-pentadecylphenylsulfinyl and 3-phenoxypropylsulfinyl), a phosphonyl group of preferably $C_1$ to $C_{56}$ (for example, phenoxyphosphonyl, octyloxyphosphonyl and phenylphosphonyl), an aryloxycarbonyl group of preferably $C_7$ to $C_{57}$ (for example, phenoxycarbonyl), an acyl group of preferably C2 to $C_{56}$ (for example, acetyl, 3-phenylpropanoyl, benzoyl and 4-dodecyloxybenzoyl) and an azolyl group of preferably $C_1$ to $C_{56}$ (for example, imidazolyl, pyrazolyl, 3-chloro-pirazol-1-yl and triazolyl).

Of these substituents, preferable substituents are an alkyl group, an aryl group, an alkoxy group, an aryloxy group, an alkylthio group, a carbamoylamino group, aryloxycarbonylamino group, an alkoxycarbonylamino group, an alkylacylamino group and arylacylamino group.

X represents a halogen atom or a releasable group in a reaction with an oxidation product of an aromatic primary amine color developing agent, and examples of the releasable group include a halogen atom, an alkoxy group, an aryloxy group, an acyloxy group, an alkyl- or aryl- sulfonyloxy group, an acylamino group, an alkyl- or aryl- sulfonamide group, an alkoxycarbonyloxy group, an aryloxycarbonyloxy group, an alkyl-, aryl- or heterocyclic thio group, a carbamoylamino group, a 5-membered or 6-membered nitrogen containing heterocyclic group, an imido group and an arylazo group. These groups may further be substituted by a group which is permitted as a substituent for $R^4$.

In more detail, examples of the releasable group include a halogen atom (for example, fluorine, chlorine and bromine), an alkoxy group of preferably $C_1$ to $C_{30}$ (for example, ethoxy, dodecyloxy, methoxyethylcarbamoylmethoxy, carboxypropyloxy, methylsulfonylethoxy and ethoxycarbonylmethoxy), an aryloxy group of preferably $C_6$ to $C_{36}$ (for example, 4-methylphenoxy, 4-chlorophenoxy, 4-methoxyphenoxy, 4-carboxy-phenoxy, 3-ethoxycarboxyphenoxy, 4-methoxycarbonylphenoxy, 3-acetylaminophenoxy and 2-carboxyphenoxy), an acyloxy group of preferably $C_2$ to $C_{36}$ (for example, acetoxy, tetradecanoyloxy and benzoyloxy), an alkyl- or aryl- sulfonyloxy group (for example methanesulfonyloxy and toluenesulfonyloxy), an acylamino group (for example, dichloracetylamino and heptafluorobutylylamino), an alkyl- or aryl- sulfonamide group (for example, methanesulfonamino, trifluoromethanesulfonamino and p-toluenesulfonylamino), an alkoxycarbonyloxy group (for example, ethoxycarbonyloxy and benzyloxycarbonyloxy), an aryloxycarbonyloxy group (for example, phenoxycarbonyloxy), an alkyl-, aryl- or heterocyclicthio group of preferably $C_1$ to $C_{36}$ (for example, dodecylthio, 1-carboxydodecylthio, phenylthio, 2-butoxy-5-tert-octylphenylthio, 2-benzyloxycarbonylaminophenylthio and tetrazolylthio) a carbamoylamino group (for example, N-methylcarbamoylamino and N-phenylcarbamoylamino), a 5-membered or 6-membered nitrogen containing heterocyclic group of preferably $C_1$ to $C_{36}$ (for example, 1-imidazolyl, 1-pyrazolyl, 1,2,4-triazole-1-yl, tetrazolyl, 3,5-dimethyl-1 -pyrazolyl, 4-cyano-1-pyrazolyl, 4-methoxycarbonyl-1-pyrazolyl, 4-acetylamino-1-pyrazolyl and 1,2-dihydro-2-oxo-1-pyridyl) an imido group (for example, succinimide and hydantoynyl) and an arylazo group (for example, phenylazo and 4-methoxyphenylazo). Preferable examples of X include a halogen atom, an alkoxy group, an aryloxy group, an alkyl- or aryl- thio group and a 5-membered or 6-membered nitrogen containing heterocyclic group which is bound to the coupling active site with a nitrogen atom. A halogen atom, a substituted aryloxy group, a substituted arylthio group and a substituted 1-pyrazolyl group are particularly preferred.

Among the compounds of formulae (III) and (IV), examples of magenta couplers which are particularly preferred are those represented by formulae (V) and (VI):

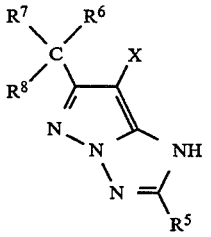

(V)

wherein $R^5$, $R^6$, $R^7$, $R^8$, X are the same as defined hereinbefore;

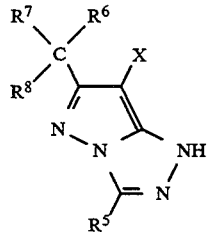

(VI)

wherein $R^5$, $R^6$, $R^7$, $R^8$, X are the same as defined hereinbefore.

Preferable examples of respective groups in formulae (III) to (VI) are as follows:

Preferable examples of X include a halogen atom, an alkoxy group, and an aryloxy group. A chlorine atom is particularly preferred.

Preferable examples of $R^4$ include an alkyl group, an alkoxy group, and an aryloxy group. An alkyl group is particularly preferred.

Preferable examples of $R^5$ include an alkyl group, an aryl group, an anilino group, and an alkoxy group. An alkyl group and an aryl group are particularly preferred, and a substituted alkyl group or a substituted aryl group is specifically preferred.

Preferable examples of $R^6$ to $R^8$ include an alkyl group, an aryl group, an anilino group and an alkoxy group. An alkyl group is particularly preferred, with methyl or ethyl being specifically preferred.

The magenta couplers of the present invention are employed in amounts of 0.001 to 1 mol, preferably, 0.003 to 0.3 mol per mol of light-sensitive silver halide present in the same layer.

Specific examples of magenta couplers represented by formulae (III) to (VI) are described below, which however, should not be construed as limiting the present invention thereto.

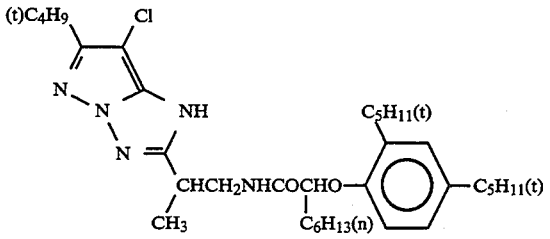

(M-1)

-continued
(M-2)
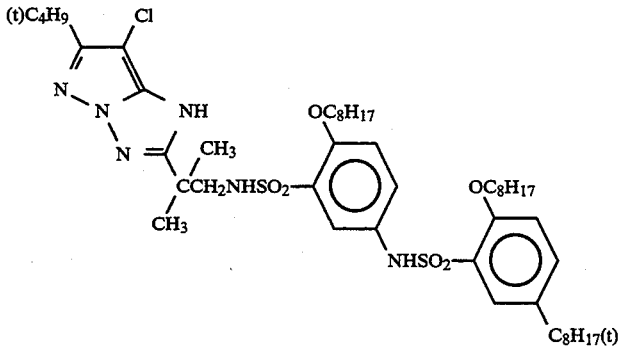
(M-3)
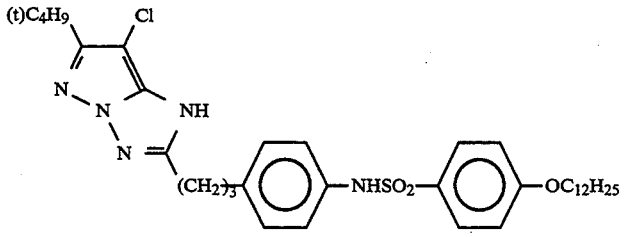
(M-4)
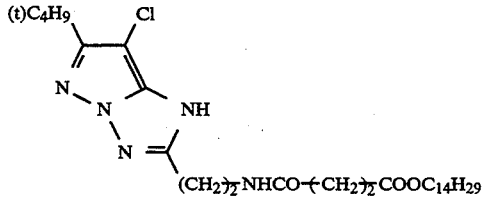
(M-5)
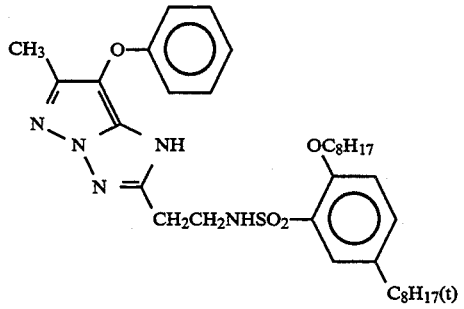
(M-6)
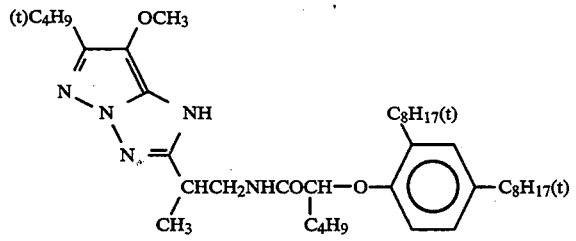
(M-7)
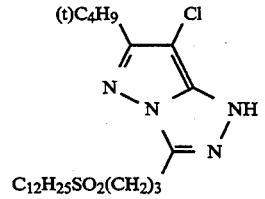

-continued
(M-8)
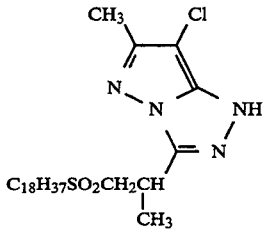
(M-9)
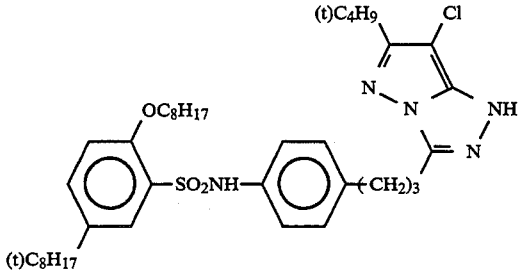
(M-10)
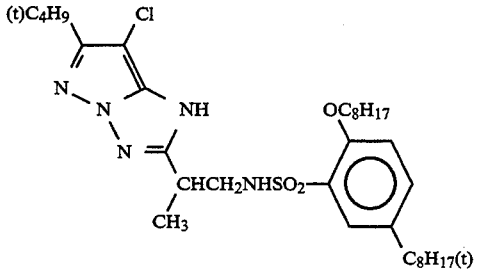
(M-11)
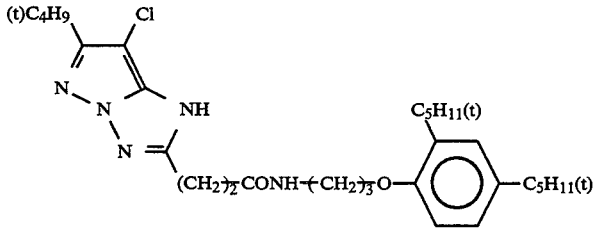
(M-12)
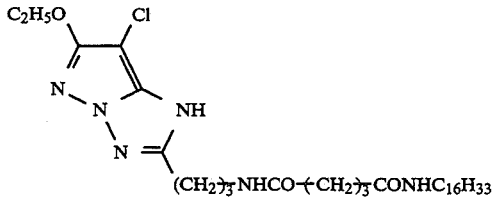
(M-13)
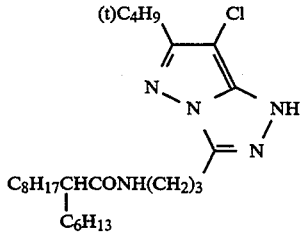

-continued
(M-14)
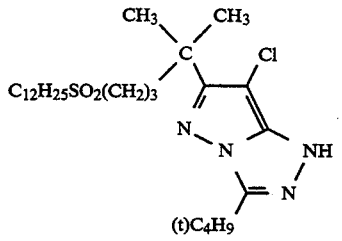
(M-15)
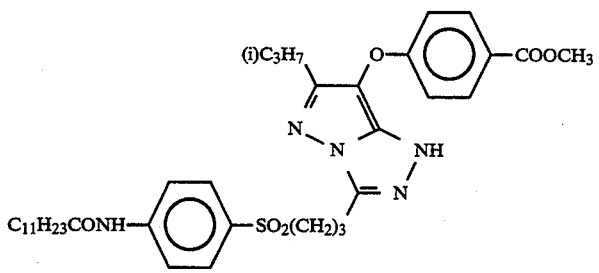
(M-16)
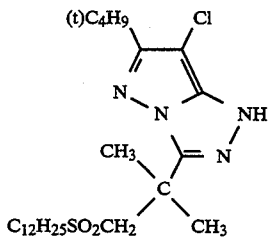
(M-17)
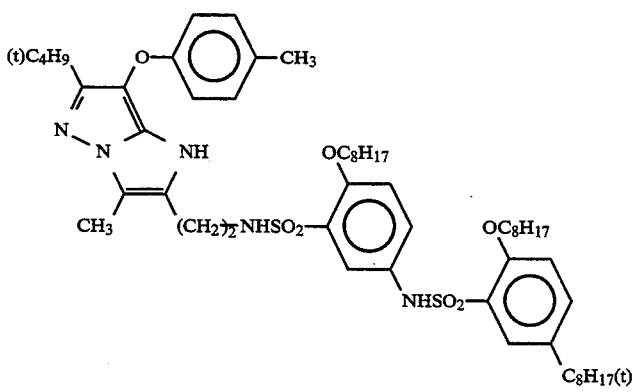
(M-18)
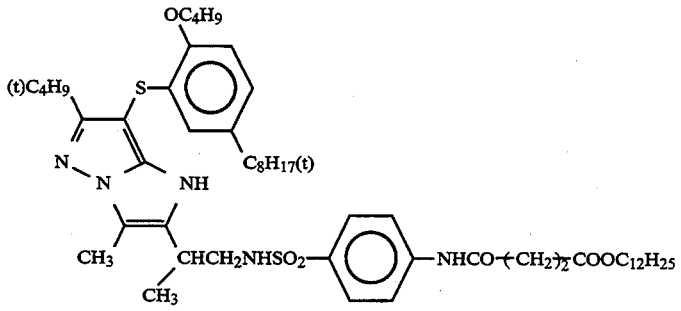

-continued (M-19)

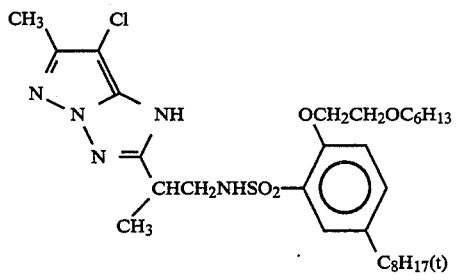

(M-20)

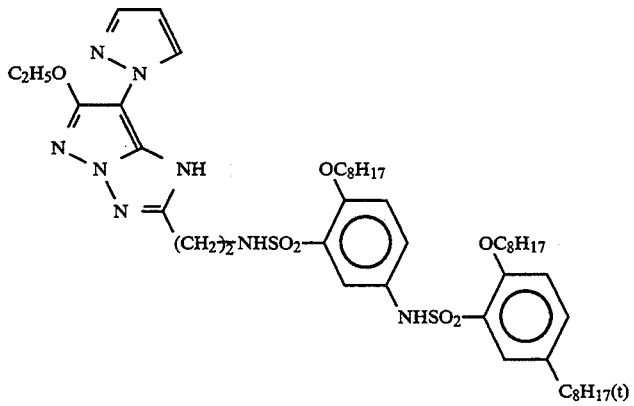

The above magenta couplers can be synthesized according to the synthesis examples described in U.S. Pat. Nos. 3,061,432 and 3,725,067, and in JP-A-60-33552 and the like.

The light-sensitive material according to the present invention has at least one layer of blue-sensitive, green-sensitive or red-sensitive silver halide emulsion layers and at least one light-nonsensitive layer provided on a support. The coupler represented by formula (III) is preferably contained in the green-sensitive layer. No limitation is imposed on the total number of and the lamination order of the silver halide emulsion layers and light-nonsensitive layers. A typical example is a silver halide color photographic light-sensitive material which comprises a support and, provided thereon, at least one light-sensitive layer comprised of a plurality of silver halide emulsion layers which have substantially identical color sensitivities but have different levels of sensitivity. The light-sensitive layers are unit light-sensitive layers which are sensitive to one of blue light, green light or red light. Moreover, in multilayer silver halide color photographic light-sensitive materials, the unit light-sensitive layers are generally superposed on a support in the order of, as viewed from the support, red-sensitive layers, green-sensitive layers and blue-sensitive layers. However, in accordance with the desired object, the lamination order may be reversed and light-sensitive layers having different color sensitivities may be sandwiched between any two adjacent light-sensitive layers having the identical color sensitivity.

Various intermediate light-nonsensitive layers may be provided between any two adjacent silver halide light-sensitive layers, and may be the uppermost layer or the lowermost layer.

The intermediate light-nonsensitive layers may contain couplers, DIR compounds and the like described in JP-A-61-43748, JP-A-59-113438, JP-A-59-113440, JP-A-61-20037 and JP-A-61-20038.

The plurality of silver halide emulsion layers which constitute each unit light-sensitive layer preferably have a two-layer structure of a high sensitivity emulsion layer and a lower sensitivity emulsion layer as described in West German Patent No. 1,121,470 or British Patent No. 923,045. In general, it is preferable that the emulsion layers are disposed in an order such that the sensitivities thereof decrease toward the support. Further, light-nonsensitive layers may be provided between any two adjacent silver halide emulsion layers. Furthermore, a low sensitivity emulsion layer may be disposed at the side remote to the support with other emulsion layers disposed in an order such that the sensitivities threreof increase toward the support, as described in JP-A-57-112751, JP-A-62-200350, JP-A-62-206541, JP-A-62-206543 and the like.

Specific examples of the order of lamination include, from the remote side of the support toward the support, a blue-sensitive layer of low sensitivity (BL), a blue-sensitive layer of high sensitivity (BH), a green-sensitive layer of high sensitivity (GH), a green-sensitive layer of low sensitivity (GL), a red-sensitive layer of high sensitivity (RH) and a red-sensitive layer of low sensitivity (RL); BH/BL/GL/GH/RH/RL; and BH/BL/GH/GL/RL/RH.

It is possible to dispose blue-sensitive layers/GH/RH/GL/RL in this order from the remote side of the support as described in JP-B-55-34932. Alternatively, it is also possible to dispose blue-sensitive layers/GL/RL/GH/RH in this order from the remote side of the support as described in JP-A-56-25738 and JP-A-62-63936.

JP-B-49-15495 discloses a three layer arrangement in which three layers having different sensitivities are disposed in an order toward the support such that the uppermost layer is a silver halide emulsion layer having the highest sensitivity, the intermediate layer is a silver halide emulsion layer of intermediate sensitivity, and the lowermost layer is a silver halide emulsion layer of the lowest sensitivity. In such a three-layer structure in which each layer has a different sensitivity, layers having the same color sensitivity may be arranged such that an emulsion layer of intermediate sensitivity/an emulsion layer of high sensitivity/an emulsion layer of low sensitivity are layered in that order from the side remote to the support as described in JP-A-59-202464.

Alternatively, orders of layering such as emulsion layer of high sensitivity/emulsion layer of low sensitivity/emulsion layer of intermediate sensitivity, and emulsion layer of low sensitivity/emulsion layer of intermediate sensitivity/emulsion layer of high sensitivity may also be applicable. In cases of four or more layers, the lamination order can be varied as described above.

In order to improve color reproduction, a donor layer (CL) which has a different spectral sensitivity distribution than the main light-sensitive layers of BL, GL, RL and the like is preferably disposed adjacent to or close to the main light-sensitive layers, as described in U.S. Pat. Nos. 4,663,271, 4,705,744, and 4,707,436, and in JP-A-62-160448 and 63-89850.

As described above, various layer structures and arrangements may be adopted according to the intended functions of the light-sensitive materials.

When the photographic light-sensitive materials according to the present invention are color negative films or color reversal films, preferable silver halides to be contained in the photographic emulsion layers are silver iodoromide, silver iodochloride or silver iodochlorobromide, all of which should contain silver iodide of not more than about 30 mol %. Of these, particularly preferred are silver iodobromide or silver iodochlorobromide containing about 2 to 25 mol % of silver iodide.

When the photographic light-sensitive materials according to the present invention are color photographic printing papers, preferable silver halides to be contained in the photographic emulsion layers are those composed of silver chlorobromide or silver chloride which substantially does not contain silver iodide. Here, the term "substantially does not contain silver iodide" means that the content of silver iodide is not more than 1 mol %, preferably, not more than 0.2 mol %. As for the halogen composition of the silver chlorobromide, any silver bromide/silver chloride can be employed. The proportion of silver bromide and silver chloride may be broadly varied according to the purposes, with not less than 2 mol % of silver chloride being preferred. For light-sensitive materials suited for rapid processing, so-called high silver chloride emulsions which have a high silver chloride content are preferably employed. The high silver chloride emulsions preferably contain not less than 90 mol %, more preferably not less than 95 mol % of silver chloride. It is also preferable to use emulsions of almost pure silver chloride, such as those containing 98 to 99.9 mol % of silver chloride, in order to reduce the replenished amount of developing solutions. Grains of the silver halides in the photographic emulsions may have various configurations including regular crystal forms such as cubic, octahedral and tetradecahedral, and irregular crystal forms such as spherical and plate-shaped. The grains may have crystal defects in the twin plane or the like, and complex forms of the grains may be used.

The silver halides may have a variety of grain sizes, from fine grains of not less than 0.2 μm to large grains whose diameter in the projected area is about 10 μm. The emulsions may be multi-disperse emulsions or mono-disperse emulsions.

The silver halide photographic emulsions which are useful in the present invention can be prepared by the methods described, for example, by Research Disclosure (RD), No. 17643 (December, 1987), pp. 22–23, "Emulsion Preparation and Types"; ibid., No. 18716 (November, 1979), p. 648; ibid., No. 307105 (November, 1989), pp. 863–865; "Chemie et Physique Photographique" by P. Glafkides, Paul Montel, 1987; "Photographic Emulsion Chemistry", by G. F. Duffin, Focal Press, 1966; and "Making and Coating Photographic Emulsion" by V. L. Zelikman et al., Focal Press, 1964.

Monodisperse emulsions disclosed in U.S. Pat. Nos. 3,574,628 and 3,655,394 and British Patent No. 1,413,748 and the like are also preferable.

Alternatively, tabular silver halide grains having an aspect ratio of not less than about 3 can also be employed in the present invention. Such tabular grains can be readily obtained by the methods described, for example, in "Photographic Science and Engineering", by Gutoff, Vol. 14, pp. 248–257 (1970), U.S. Pat. Nos. 4,434,226, 4,414,310, 4,433,048 and 4,439,520 and British Patent No. 2,112,157.

The crystal structure may be uniform throughout the grains, or the outer portion and inner portion of the crystals may have different halogen compositions. Moreover, the crystal structure may be a layered structure. Furthermore, silver halide gains of different compositions may be linked by an epitaxial bond, or compounds other than silver halide such as silver rhodanide and lead oxide may be used to link the grains. Mixtures of grains having various crystal forms may also be employed.

The above described emulsions may be a surface latent image type which forms latent images mainly in the surface portion of the grains, an internal latent image type which forms latent images inside of the grains, or a type forming latent images both on the surface and inside of the grains. However, it is necessary that the emulsions be negative type emulsions. When the emulsions are the internal latent image type, core/shell internal latent image type emulsions described in JP-A-63-264740 may be employed. A process for preparing core/shell internal latent image type emulsions is described in JP-A-59-133542. The thickness of the shells of the emulsions of this type varies depending on the development process and the like, but is preferably 3 to 40 nm, and 5 to 20 nm is particularly preferable.

In practice, silver halide emulsions are generally used after being physically ripened, chemically ripened and spectral-sensitized. Additives which are used in such treatment processes are disclosed in RD, Nos. 17643, 18716 and 307105, the relevant portions of which are included in tables hereinlater.

Two or more kinds of emulsions which differ from each other in at least one characteristic of grain size, grain size distribution, halogen composition, grain configuration or sensitivity of the silver halide grains in the light-sensitive silver halide emulsion may be mixed in the same layer to be used in the light-sensitive materials according to the present invention.

The light-sensitive silver halide emulsion layers and/or substantially light-nonsensitive hydrophilic colloid layers preferably contain surface-fogged silver halide grains described in U.S. Pat. No. 4,082,553 and interior-fogged silver halide grains and colloid silver described in U.S. Pat. No. 4,626,498 and in JP-A-59-214852. The interior-fogged or surface-fogged silver halide grains are defined to be silver halide grains by which uniform development (forming no images) is possible irrespective of the unexposed part or exposed part of the light-sensitive materials. Processes for preparing such interior-fogged or surface-fogged silver halide grains are described in U.S. Pat. No. 4,626,498 and in JP-A-59-214852.

The silver halides which form interior nuclei of interior-fogged core/shell type silver halide grains may have identical or different halogen compositions. Any one of silver chloride, silver chlorobromide, silver iodobromide or silver chloroiodobromide may be used for preparing interior-fogged or surface-fogged silver halide grains. No particular limitation is imposed on the grain size of these fogged silver halide grains. It is preferable that an average grain size be 0.01 to 0.75 μm, and average grain sizes of 0.05 to 0.6 μm are particularly preferred. There is no limitation on the shape of the grains, and regular shape grains may be used. Although multi-disperse emulsions may be used, mono-disperse emulsions (at least 95% by weight or by grain number of silver halide grains having grain diameter of average grain diameter plus/minus 40%) are preferred.

It is preferable that light-nonsensitive fine grain silver halides are used in the present invention. The light-nonsensitive fine grain silver halides are fine grains of silver halides which are not sensitized at the image forming exposure for obtaining color images, and therefore, are substantially not developed in the developing process. In this case, the silver halide grains are preferably not fogged in advance.

The fine grain silver halides contain 0 to 100 mol % of silver bromide. Silver chloride and/or silver iodide may also be included as desired. Preferably, silver iodide is contained in an amount of 0.5 to 10 mol % based on the total weight of the silver halides.

The fine grain silver halides have an average grain size (average value of diameter of a circle having the same area as the projected area) of 0.01 to 0.5 μm, and more preferably 0.02 to 0.2 μm.

The fine grain silver halides can be prepared by the same method as ordinary light-sensitive silver halides are prepared. In this case, it is unnecessary to chemically sensitize the surface of the silver halides. Spectral sensitization is not necessary, either. However, before adding the fine grain silver halides to a coating solution, it is preferable that known stabilizers such as triazole type, azaindene type, benzothiazolium type or mercapto type compounds or zinc compounds are added thereto beforehand. Layers which contain fine grain silver halide grains may preferably contain colloid silver.

The amount of silver to be coated in the light-sensitive materials according to the present invention is preferably not greater than 6.0 g/m$^2$, and most preferably not greater than 4.5 g/m$^2$.

Known photographic additives which are useful in the present invention are also described in the above-mentioned three RD publications. In Table 1 below, the relevant portions of these publications are listed.

TABLE 1

| Additive | RD No. 17643 | RD No. 18716 | RD No. 307105 |
|---|---|---|---|
| 1. Chemical sensitizers | p 23 | p 648 right column | p 866 |
| 2. Sensitivity increasing agents | | p 648 right column | |
| 3. Spectral sensitizers, | p 23–p 24 | p 648 right column– | p 866–p 868 |

TABLE 1-continued

| Additive | RD No. 17643 | RD No. 18716 | RD No. 307105 |
|---|---|---|---|
| Supersensitizers | | p 649 right column | |
| 4. Brightening agents | p 24 | p 647 right column | p 868 |
| 5. Antifogging agents, Stabilizers | p 24–p 25 | p 649 right column | p 868–p 870 |
| 6. Light absorbers, Filter dyes, UV absorbers | p 25–p 26 | p 649 right column– p 650 left column | p 873 |
| 7. Stain inhibitors | p 25 right column | p 650 left col.–right column | p 872 |
| 8. Color image stabilizers | p 25 | p 650 left column | p 872 |
| 9. Hardeners | p 26 | p 651 left col. | p 874–875 |
| 10. Binders | p 26 | p 651 left col. | p 873–874 |
| 11. Plasticizers, Lubricants | p 27 | p 650 right column | p 876 |
| 12. Coating aids, Surfactants | p 26–27 | p 650 right column | p 875–876 |
| 13. Antistatic agents | p 27 | p 650 right col. | p 876–877 |
| 14. Matte agents | | | p 878–879 |

Moreover, in order to prevent deterioration of photographic performance caused by the presence of formaldehyde gas, it is advisable to add, into light-sensitive materials, compounds capable of fixing formaldehyde by reaction therewith which are described in U.S. Pat. Nos. 4,411,987 and 4,435,503.

It is preferable that the mercapto compounds described in U.S. Pat. Nos. 4,740,454 and 4,788,132, and in JP-A-62-18539 and JP-A-1-283551 are included in the light-sensitive materials of the present invention.

Furthermore, irregardless of the amounts of silver produced in the development process, it is preferable that the light-sensitive materials according to the present invention contain fogging agents, development accelerators, solvents for silver halides, and compounds which release their precursors in amounts.

The light-sensitive materials according to the present invention preferably contain dyes which are dispersed by methods described in PCT International Publication No. WO88/04794 and JP-A-1-502912 or dyes described in EP 317,308A, U.S. Pat. No. 4,420,555 and JP-A-1-259358.

Various color couplers can be used in the present invention, specific examples of which are described in the patents cited in aforementioned RD, No. 17643, VII, C-G and ibid., No. 307135, VII, C-G.

As for yellow couplers, preferable examples include those described in U.S. Pat. Nos. 3,933,501, 4,022,620, 4,326,024, 4,401,752 and 4,248,961, JP-B-58-10739, British Patent Nos. 1,425,020 and 1,476,760, U.S. Pat. Nos. 3,973,968, 4,314,023 and 4,511,649 and European Patent Application No. 249,473A.

Examples of magenta couplers include compounds represented by formula (III). In addition, those described in U.S. Pat. Nos. 4,310,619 and 4,351,897, European Patent No. 73,636, U.S. Pat. Nos. 3,061,432 and 3,725,067, Research Disclosure No. 24220 (June, 1984), JP-A-60-33552, Research Disclosure No. 24230 (June, 1984), JP-A-60-43659, JP-A-61 -72238, JP-A-60-35730, JP-A-55-118034 and JP-A-60-185951, U.S. Pat. Nos. 4,500,630, 4,540,654 and 4,556,630 and PCT International Publication No. W088/04795, and the like are preferred.

As for cyan couplers, mention may be given to phenol type and naphthol type couplers. Preferable examples of cyan couplers are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (OLS) No. 3,329,729, European Patent Application Nos. 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658. Furthermore, pyrazoloazole type couplers described in JP-A-64-553, 64-554, 64-555, 64-556, and imidazole type couplers described in U.S. Pat. No. 4,818,672 can also be used.

Typical examples of polymerized color forming couplers are described, for example, in U.S. Pat. Nos. 3,451,820, 4,080,211, 4,367,282, 4,409,320 and 4,576,910, British Patent No. 2,102,137 and European Patent Application No. 341,188A.

As for couplers with which the color generating dyes have an adequate diffusion property, preferable ones are those described in U.S. Pat. No. 4,366,237, British Patent No. 2,125,570, European Patent No. 96,570 and West German Patent (OLS) No. 3,234,533.

Preferable examples of colored couplers for compensating for unnecessary absorptions of color generating dyes include those described in RD, No. 17643, VII-G, ibid. No. 307105, VII-G, U.S. Pat. No. 4,163,670, JP-B-57-39413, U.S. Pat. Nos. 4,004,929 and 4,138,258 and British Patent No. 1,146,368. It is also preferable to use couplers described in U.S. Pat. No. 4,774,181, which compensate for unnecessary absorptions of color generating dyes by the fluorescent dyes released at the time of coupling, and couplers described in U.S. Pat. No. 4,777,120, which have, as a releasable group, a dye precursor group capable of forming dyes by the reaction with a developing agent.

Compounds which release photographically useful residues in the coupling reaction are also useful in the present invention. Preferable examples of DIR couplers which release development inhibitors are disclosed in the patents cited in the aforementioned RD, No. 17643, VII-F, ibid. No. 307105, VII-F, JP-A-57-151944, JP-A-57-154234, JP-A-60-184248, JP-A-63-37346 and JP-A-63-37350, U.S. Pat. Nos. 4,248,962 and 4,782,012.

Couplers which release bleach accelerators as described in RD, No. 11449, ibid., No. 24241 and JP-A-61-201247 are effective for making the bleaching processing time shorter. When such couplers are added to light-sensitive materials which utilize aforementioned tabular silver halide grains, they are particularly effective and advantageous. Preferable couplers which release nucleating agents or development accelerators in the configuration of the images in the developing process include those described in British Patent Nos. 2,097,140 and 2,131,188, and JP-A-59-157638 and JP-A-59-170840. Other preferable compounds include those which release fogging agents, development accelerators, solvents for silver halides by the oxidation-reduction reaction with an oxidation product of a developing agent, which are described in JP-A-60-107029, JP-A-60-252340, JP-A-1-44940 and JP-A-1-45687.

Other compounds which can be used in the light-sensitive materials of the present invention include competitive couplers described, for example, in U.S. Pat. No. 4,130,427, multi-equivalent couplers described, for example, in U.S. Pat. Nos. 4,283,472, 4,338,393 and 4,310,618, DIR redox compound releasing couplers, DIR coupler releasing couplers, DIR coupler releasing redox compounds and DIR redox releasing redox compounds described, for example, in JP-A-60-185950 and JP-A-62-24252, couplers which release dyes which recover the initial colors after being released described, for example, in European Patent Application Nos. 173,302A and 313,308A, ligand releasing couplers described, for example, in U.S. Pat. No. 4,555,477, couplers which release leuco dyes described in JP-A-63-75747, and couplers which release fluorescent dyes described in U.S. Pat. No. 4,774,181.

The couplers which are used in the present invention can be introduced into light-sensitive materials by various known dispersion methods.

Examples of high boiling point solvents which are useful in the oil-in-water dispersion method are described, for example, in U.S. Pat. No. 2,322,027. Examples of high boiling point organic solvents having a boiling point of 175° C. or higher at atmospheric pressure and applicable to the oil-in-water dispersion method include phthalic esters (for example, dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate); esters of phosphoric acid or phosphonic acid (for example, triphenyl phosphate, tricresyl phosphate, 2-ethylhexyl diphenylphosphate, tricyclohexyl phosphate, tri-2-ethylhexyl phosphate, tridodecyl phosphate, tributoxyethyl phosphate, trichloropropyl phosphate, di-2-ethylhexyl phenylphosphate); benzoic esters (for example, 2-ethylhexyl benzoate, dodecylbenzoate, 2-ethylhexyl-p-hydroxybenzoate); amides (for example, N,N-diethyldodecaneamide, N,N-diethyllaurylamide and N-tetradecylpyrolidone); alcohols and phenols (for example, isostearyl alcohol and 2,4-di-tert-amylphenol); aliphatic carboxylic esters (for example, bis (2-ethylhexyl)sebacate, dioctylazelate, glycerol tributylate, isostearyl lactate and trioctylcitrate); aniline derivatives (for example, N,N-dibutyl-2-butoxy-5-tert-octylaniline); and hydrocarbons (for example, paraffin, dodecyl benzene and diisopropylnaphthalene). Auxiliary solvents may also be used which include organic solvents having a boiling point of about 30° C. or higher, and preferably between 50° and about 160° C. Examples of such solvents include ethyl acetate, butyl acetate, ethyl propionate, methylethylketone, cyclohexanone, 2-ethoxyethyl acetate and dimethylformamide.

Specific examples of the steps of latex dispersion method, effects thereof, and latexes to be used for impregnation are described, for example, in U.S. Pat. No. 4,199,363, West German Patent (OLS) Nos. 2,541,274 and 2,541,230.

It is preferable that the color photographic light-sensitive materials of the present invention contain various preservatives or anti-fungal agents such as 1,2-benzisothiazolin-3-one, n-butyl-p-hydroxybenzoate, phenol, 4-chloro-3,5-dimethylphenol, 2-phenoxyethanol and 2-(4-thiazolyl)benzimidazole as described in JP-A-63-257747, JP-A-62-272248 and JP-A-1-80941 and phenethyl alcohol.

The present invention can be applicable to a variety of color photographic light-sensitive materials, typified by color negative films for general use or movies, color reversal films for slides or television, color papers, color positive films and color reversal films.

Supports which are suited for use in the present invention are described, for example, in the aforementioned RD, No. 17643, page 28, ibid., No. 18716 page 647, right column to page 648, left column and ibid., No. 307105, page 879.

It is preferable that the total thickness of all of the hydrophilic colloid layers on the side having emulsion layers is not more than 28 μm, more preferably not more than 23 μm, still more preferably not more than 18 μm, and most preferably not more than 16 μm. Moreover, the layer swelling speed $T_{178}$ is preferably not more than 30 seconds, and more preferably not more than 20 seconds. "Layer thickness" as used herein is that measured at 25° C. under a relative humidity of 55% RH (2 days). The layer swelling speed $T_{\frac{1}{2}}$ can be measured by methods known in the art. For instance, a swellometer of a type described in "Photographic Science and Engineering", Vol. 19, No. 2, 124–129 as proposed by A. Green et al. can be employed. $T_{\frac{1}{2}}$ is defined to be the period of time required for the thickness of the layer to reach half of the saturated layer thickness under the conditions that 90% of the maximum thickness of the swollen layer obtained by treating the layer in a color developer of 30° C. for 3 minutes and 15 seconds is considered to be the saturated layer thickness.

The layer swelling speed $T_{\frac{1}{2}}$ is controlled by adding a hardening agent to gelatin which serves as a binder, or by changing the amount of time after coating. It is preferable that the swelling rate is from 150 to 400%. The swelling rate can be calculated, using the maximum thickness of the swollen layer under the above mentioned conditions, from the following equation: [(maximum thickness of swollen layer)−(thickness of layer)]/(thickness of layer).

It is preferable that the light-sensitive materials according to the present invention have hydrophilic colloidal layers (hereinafter referred to as backing layers) such that the total thickness of all the hydrophilic layers in a dry state falls in the range of 2 to 20 μm, on a side of support opposite to the side at which the emulsion layers are provided. The backing layers preferably contain aforementioned optical absorbers, filter dyes, UV absorbers, anti-static agents, hardening agents, binders, plasticizers, lubricants, coating aids, surfactants, and the like. The swelling rate of a backing layer is preferably 150 to 500%.

According to the present invention, color photographic light-sensitive materials can be developed by conventional methods described in the aforementioned RD, No. 17643, pages 28–29, ibid., No. 18716, page 651, left through right columns and ibid., No. 307105, pages 880 to 881.

Color developers which are useful for developing the light-sensitive materials according to the present invention are aqueous alkaline solutions containing, as main ingredients, aromatic primary amine type color developing agents. Aminophenol type compounds may be mentioned as a useful color developing agent. Preferably, however, p-phenylenediamine type compounds are used, typical examples of which include 3-methyl-4-amino-N,N-diethylaniline, 3-methyl-4-amino-N-ethyl-N-β-hydroxyethylaniline, 3-methyl-4-amino-N-ethyl-N-β-methanesulfonamide ethyl aniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and their sulfates, hydrochlorides and p-toluenesulfonates. Of these, particularly preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, their hydrochlorides, p-toluenesulfonate and sulfates. These compounds may be used in a combination of two or more according to the purpose.

Color developers generally contain pH buffers such as carbonates, borates and phosphates of alkali metals, as well as development inhibitors or antifogging agents such as chlorides, bromides, iodides, benzimidazoles, benzthiazoles and mercapto compounds. As needed, the following agents may also be incorporated: hydrazines such as hydroxylamine, diethylhydroxylamine, sulfites and N,N-biscarboxymethylhydrazine; various preservatives such as phenylsemicarbazides, triethanolamine and catecholsulfonic acid; organic solvents such as ethylene glycol and diethylene glycol; development accelerators such as benzylalcohol, polyethylene glycol, quaternary ammonium salts and amines; color forming couplers; competitive couplers; auxiliary developing agents such as 1-phenyl-3-pyrazolidone; viscosity imparting agents; various chelating agents typified by aminopolycarboxylic acid, aminopolyphosphonic acid, alkylphosphonic acid and phosphonocarboxylic acid, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylene phosphonic acid, ethylenediamine-N,N-N',N'-tetramethylenephosphonic acid, ethylenediamine-di(o-hydroxyphenylacetic acid) and salts thereof.

In general, when reversal processing is performed, a color development step follows a black-and-white development step. In black-and-white developing solutions, known black-and-white developing agents, for example, dihydrobenzenes such as hydroquinone, 3-pyrazolidones such as 1-phenyl-3 -pyrazolidone and aminophenols such as N-methyl-p-aminophenol are used alone or in combination. The pH of the color developing solutions and black-and-white developing solutions is generally 9 to 12. The replenishing amount of these developing solutions depends on the type of color photographic light-sensitive material to be processed. In general, the amount does not exceed 3 liters per square meter of the light-sensitive material. It can be made to 500 ml/m$^2$ or less by reducing the concentration of bromide ions in the replenisher. In a case in which the replenishing amount is reduced, it is preferable to reduce the area of the solution in the processing tank that contacts the air so as to prevent the solution from being evaporated or oxidized.

The contact area of the photographic processing solution and the air in the processing tank is expressed by the opening ratio as defined below: Opening Ratio=[contact area ($cm^2$) between processing solution and air]/[volume ($cm^3$) of processing solution]

The opening ratio is preferably not greater than 0.1, and is more preferably 0.001 to 0.05. In order to reduce the opening ratio, covers such as a floating lid may be placed on the surface of the photographic processing solution in the processing tank. Alternatively, a movable lid described in JP-A-1-82033 may be used, or a slit developing method described in JP-A-63-216050 may be used. Reduction of the opening ratio is advisable not only in the color development and the black-and-white development steps, but also in all of the subsequent steps including bleaching, bleaching-fixing, fixing, washing and stabilizing. The replenishing amount can also be reduced by adopting means for restraining the accumulation of bromide ions in the developer.

The time required for the color developing process is normally set from 2 to 5 minutes. This time can be shortened by making the temperature and the pH high and by using a high concentration of the color developing agent.

After color development, the photographic emulsion layers are usually subjected to bleach processing. Bleaching processing may be performed simultaneously with fixing processing (bleaching-fixing processing) or may be performed independently from fixing processing. Further, for the purpose of rapid processing, a processing method wherein a bleaching-fixing processing is carried out after bleaching processing may be employed. Moreover, it may be appropriate depending on the purpose to process using a continuous two tank bleaching-fixing bath to conduct fixing processing before bleaching-fixing processing, or to conduct bleaching processing after bleaching-fixing processing. Examples of bleaching agents include compounds of a multivalent metal such as iron (III), peracids, quinones and nitro compounds. Typical examples of the bleaching agents include organic complex salts of iron (III), for example, complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, and complex salts of citric acid, tartaric acid and malic acid and the like. Of these compounds, iron (III) complex salts of aminopolycarboxylic acids such as iron (III) complex salt of ethylenediaminetetraacetic acid and iron (III) complex salt of 1,3-diaminopropanetetraacetic acid are preferred in view of rapid processing and less environmental pollution. Furthermore, iron (III) complex salts of aminopolycarboxylic acids are particularly useful in both bleaching solutions and bleaching-fixing solutions. The pH of the bleaching solution or bleaching-fixing solution containing these iron (III) complex salts of an aminopolycarboxylic acid is usually in a range from 4.0 to 8. For the purpose of rapid processing, it is possible to process at a pH lower than this range.

The bleaching solution, the bleaching-fixing solution and a prebath thereof may contain a bleaching accelerator, if desired. As for specific examples of useful bleaching accelerator, the following patent specifications are referred to. U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53 -28426, and RD, No. 17129 (July, 1978) disclose compounds having a mercapto group or a disulfide group; JP-A-50-140129 discloses thiazolidine derivatives; JP-B-45-8506, JP-A-52-20832 and JP-A-53-32735 and U.S. Pat. No. 3,706,561 disclose thiourea derivatives; West German Patent No. 1,127,715 and JP-A-58-16235 disclose iodides; West German Patents Nos. 966,410 and 2,748,430 disclose polyoxyethylene compounds; JP-B=45-8836 discloses polyamine compounds; JP-A-49-40943, JP-A-49-59644, JP-A-53-94927, JP-A- 54-35727, JP-A-55-26506 and JP-A-58-163940 disclose useful compounds; and bromide ions and the like may be used. Of these compounds, the compounds having a mercapto group or a disulfide group are preferred in view of their excellent bleach accelerating effects. Particularly, the compounds described in U.S. Pat. No. 3,893,858, West German Patent No. 1,290,812 and JP-A-53-95630 are preferred. Further, the compounds described in U.S. Pat. No. 4,552,834 are also preferred. These bleaching accelerators may be incorporated into color photographic light-sensitive materials. The accelerators are especially effective when bleaching-fixing color photographic light-sensitive materials for photographic use.

It is preferable that, besides the above compounds, an organic acid is included in the bleaching solution or the bleaching-fixing solution for preventing bleach stains. Especially preferable organic acids are compounds having an acid dissociation constant (pKa) of 2 to 5. Specific examples of such preferable compounds include acetic acid, propionic acid and hydroxyacetic acid.

Fixing agents which can be employed in the fixing solution or bleaching-fixing solution include thiosulfates, thiocyanates, thioether compounds, thioureas and a large amount of iodide. Among these, thiosulfates are generally employed. Particularly, ammonium thiosulfate is most widely employed. Combined use of thiosulfates with thiocyanates, with thioether compounds or with thioureas is also preferable. Preferable examples of preservatives for the fixing solution or the bleaching-fixing solution include sulfites, bisulfites, carbonylbisulfite adducts and sulfinic compounds described in European Patent Application No. 294,769A. Further, the fixing solution and bleaching-fixing solution preferably contain various aminopolycarboxylic acids and organic phosphonic acids for the purpose of stabilizing the solutions.

In the present invention, in order to regulate the pH, it is preferable that the bleaching solution and the bleaching-fixing solution contain 0.1 to 10 mol/liter of a compound having a pKa of 6.0 to 9.0, preferably, imidazols such as imidazol, 1-methylimidazol, 1-ethylimidazol or 2-methylimidazol.

It is preferable that the total time required for desilverization is short and is within a range in which defects due to silver removal will not be caused. Preferably, the period of time for desilverization is 1 to 3 minutes, and more preferably from 1 to 2 minutes. The temperature at which the desilverization is performed is 25 to 50° C., preferably 35° to 45° C. Within the preferable range of temperature, the desilverization speed increases, and stains are effectively prevented from occurring after the desilverization step.

In the desilverization step, stirring is preferably intensified as much as possible. Specific examples of intensifying methods include a method of colliding a jet of the processing solution onto the surface of emulsion layers of light-sensitive materials described in JP-A-62-183460; a method of enhancing stirring efficiency by the use of a rotation means described in JP-A-62-183461; a method of further enhancing stirring efficiency making use of turbulence generated in the surface of the emulsion by transferring the light-sensitive material while allowing wiper blades provided in the processing solution to contact with the surface of the emulsion layers; and a method of increasing the circulating flow amount of the entire processing solution. These means for enhancing stirring performance are effective for any of the bleaching, bleaching-fixing or fixing solutions. The improvement in the stirring performance is thought to hasten the supply of the bleaching agents or fixing agents into the emulsion layers, leading to an increase in the speed of desilverization. Further, the above-mentioned means for enhancing the stirring performance are more effective when a bleach accelerator is used. In this case, the accelerating effect can be significantly enhanced or fixing inhibition action of the bleach accelerator can be eliminated.

Automatic developing apparatuses which are suited for use with the light-sensitive materials according to the present invention preferably have means for conveying light-sensitive materials described in JP-A 60-191257, JP-A-60-191258 and JP-A-60-191259. As described in JP-A-60-191257, such means can remarkably reduce the carrying-over of the processing solution from baths of earlier processes to baths of later processes, which provides an enhanced effect of preventing deterioration of the performances of the processing solutions. Such an effect is especially advantageous in shortening the processing time of each step or in reducing the replenishing amount of the processing solution.

After the desilverizing step, the silver halide color photographic light-sensitive material according to the present invention is generally subjected to a water washing step and/or a stabilizing step. The amount of rinsing water required for the water washing step may be determined over a wide range depending on the characteristics of photographic light-sensitive materials (for example, materials used such as couplers), uses thereof, temperature of the rinsing water, the number of rinsing tanks (number of stages), the replenishing system such as countercurrent or direct flow current, or other various conditions. The relation between the number of rinsing tanks and the amount of the rinsing water in a multi-stage countercurrent system can be determined based on the method described in the Journal of the Society of Motion Picture and Television Engineers, Vol. 64, pp. 248–253 (May, 1955). According to the multi-stage countercurrent system described in the above publication, the amount of the rinsing water can be substantially reduced. However, due to the increase in the time during which the water stays in the tank, bacteria propagate therein, resulting in the adhering of suspended matters to the light-sensitive material. The processing of color photographic light-sensitive materials according to the present invention can overcome this problem by effectively utilizing a method of reducing calcium and magnesium ions described in JP-A-62-288838. Further, it may be possible to employ isothiazolone compounds and thiabendazols disclosed in JP-A-57-8542; chlorine disinfectants such as chlorinated sodium isocyanurate; benzotriazol and the like; and disinfectants described in "Chemistry of Bacteria-Preventing Agents and Fungus-Preventing Agents" by Hiroshi HORIGUCHI, Sankyo Shuppan (1986), "Sterilization, Pasteurization and Fungus Prevention Techniques of Microorganisms" edited by Eisei Gijutsukai (1982), and "Dictionary of Disinfectants and Fungicides" edited by Kogyo Gijutsukai and Nippon Bohkin Bohbai Gakkai (1986).

The pH of the rinsing water for processing light-sensitive materials in accordance with the present invention is in the range of 4 to 9, and preferably from 5 to 8. The temperature of the rinsing water and the washing time may be set in accordance with the characteristics of the light-sensitive material used and its use. In general, the setting may be from 20 seconds to 10 minutes at 15° to 45° C., preferably, 30 seconds to 5 minutes at 25° to 40° C. Further, the light-sensitive material used in this invention can be directly processed with a stabilizing solution instead of rinsing water. For this stabilizing processing, the well-known methods disclosed in JP-A-57-8543, JP-A-58-14834 and JP-A-60-220345 can be used.

A stabilizing process may follow the above-mentioned water-washing process. As an example, a stabilizing bath containing a dye stabilizer and a surfactant may be used as a final stage bath for processing color light-sensitive materials for photography. Examples of the dye stabilizers include aldehydes such as formalin and glutaraldehyde, N-methylol compounds, hexamethylenetetramine and adducts of aldehydes and sulfurous acid. Various chelating agents and anti-fungal agents may also be added to the stabilizing bath.

The overflow solution resulting from the abovementioned water washing and/or the replenishment of the stabilizing solution can be reused in other steps such as desilverization process.

In processing by the use of an automatic developing apparatus or the like, if the processing solutions become concentrated due to evaporation, it is preferable to correct the concentration by adding water thereto.

The silver halide color photographic light-sensitive materials used in the present invention may contain a color developing agent for the purpose of simplifying and expediting the processing. In order to incorporate the color developing agent, it is preferable to employ various precursors of color developing agents. Suitable examples of precursors of color developing agents include indoaniline type compounds described in U.S. Pat. No. 3,342,597; Schiff's base type compounds described in U.S. Pat. No. 3,342,599, RD No. 14850 and ibid. No. 15159; aldol compounds described in RD No. 13924; metal salt complexes described in U.S. Pat. No. 3,719,492; and urethane type compounds described in JP-A-53-135628.

The silver halide color light-sensitive materials used in the present invention may contain, as needed, various 1-phenyl-3-pirazolidones for the purpose of accelerating the color development. Examples of typical compounds include those disclosed in JP-A-56-64339, JP-A-57-144547 and JP-A-58-115438.

In the present invention, various processing solutions are employed in a temperature range from 10° to 50° C. Although standard temperatures are from 33° to 38° C., it is possible to carry out processing at higher temperatures in order to accelerate the processing so that the time required for processing is shortened, or at lower temperatures in order to improve image quality and to maintain stability of the processing solutions.

The silver halide color photographic light-sensitive materials according to the present invention are useful when applied to lens-containing film units described, for example, in JP-B-2-32615 and Japanese Utility Model Application Publication 3-39784, and readily exhibit their effects.

The present invention is now explained in detail with reference to the following examples, which however, should not be construed as limiting the invention thereto.

EXAMPLE 1

A surface of a paper support, both surfaces of which were laminated with polyethylene, was subjected to corona discharging treatment, and thereafter a gelatin undercoat layer containing sodium dodecylbenzenesulfonate was provided thereon. Furthermore, various photographic constituent layers were formed thereon so as to prepare a multilayer color printing paper 101 having the structure described below. The coating solutions were prepared in the following manner.

Preparation of coating solution for the first layer:

153.0 g of Yellow Coupler (ExY), 15.0 g of color image stabilizer (Cpd-1), 7.5 g of color image stabilizer (Cpd-2) and 16.0 g of color image stabilizer (Cpd-3) were dissolved in 25.0 g of a solvent (Solv-1), 25 g of another solvent (Solv-2) and 180 ml of ethyl acetate, and the resulting solution was emulsified in 1000 g of 10% aqueous gelatin solution containing 60 ml of 10% sodium dodecylbenzenesulfonate and 10 g of citric acid so as to prepare an emulsified dispersion A. Separately, a silver chlorobromide emulsion A was prepared (cubic; a 3:7 mixture (molar ratio based on silver) of large grain emulsion A having an average grain size of 0.88 μm and small grain emulsion A having an average grain size of 0.70 μm; the variation coefficients of the grain size distributions being 0.08 and 0.10, respectively; both emulsions containing 0.3 mol % of silver bromide deposited locally on part of the grain surface). To the silver chlorobromide emulsion A was added blue-sensitive spectral sensitizing dyes A and B in amounts of $2.0\times10^{-4}$ mol per mol of silver for the large grain emulsion A, and $2.5\times10^{-4}$ mol per mol of silver for the small grain emulsion A, respectively. The emulsion was chemically ripened by a sulfur sensitizer and a gold sensitizer being added thereto. The above emulsified dispersion A and the silver chlorobromide emulsion A were mixed and dissolved to prepare a coating solution for the first layer having the composition described hereinafter. For the silver halide emulsions, the numerals indicate coated weights converted to silver.

Coating solutions for the second to seventh layers were prepared in the same manner as the coating solution for the first layer. 1-Hydroxy-3,5-dichloro-sec-triazine sodium salt was used as a gelatin hardener for each layer.

Cpd-14 and Cpd-15 were added to each layer in amounts such that the total amount of each was 25.0 mg/m$^2$ and 50.0 mg/m$^2$, respectively.

The following spectral sensitizing dyes were used for the silver chlorobromide emulsion of the respective light-sensitive emulsion layers.

TABLE 2

Blue-sensitive emulsion layer

Sensitizing dye A

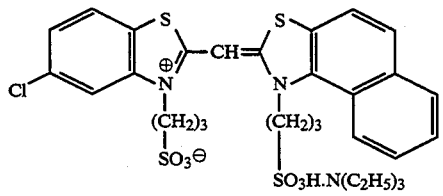

and

Sensitizing dye B

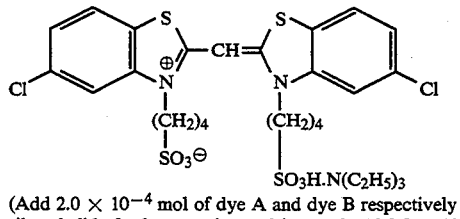

(Add $2.0\times10^{-4}$ mol of dye A and dye B respectively per mol of silver halide for large grain emulsion, and add $2.5\times10^{-4}$ mol of dye A and dye B respectively per mol of silver halide for small grain emulsion)

TABLE 3

Green-sensitive emulsion layer

Sensitizing dye C

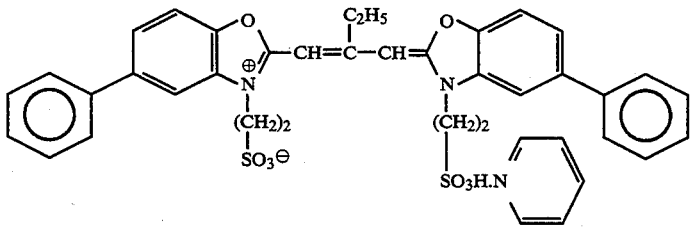

($4.0\times10^{-4}$ mol/mol of silver halide for large grain emulsion, and $5.6\times10^{-4}$ mol/mol of silver halide for small grain emulsion)

Sensitizing dye D

TABLE 3-continued

Green-sensitive emulsion layer

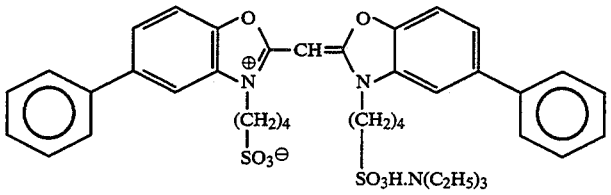

($7.0 \times 10^{-5}$ mol/mol of silver halide for large grain emulsion, and $1.0 \times 10^{-4}$ mol/mol of silver halide for small grain emulsion)

TABLE 4

Red-sensitive emulsion layer

Sensitizing dye E

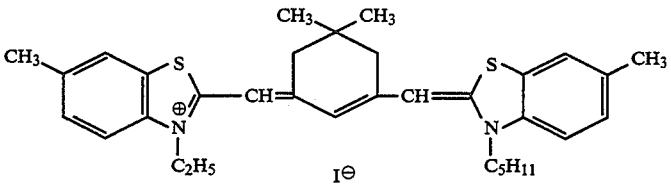

($0.9 \times 10^{-4}$ mol/mol of silver halide for large grain emulsion, and $1.1 \times 10^{-4}$ mol/mol of silver halide for small grain emulsion)

Further, the following compound was added in an amount of $2.6 \times 10^{-3}$ mol/mol of of silver halide.

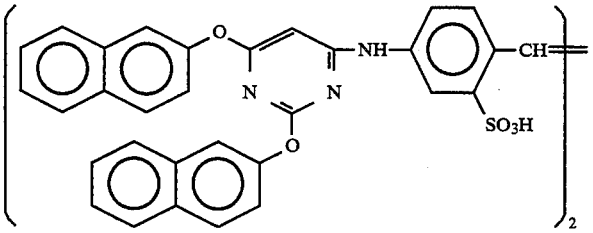

Moreover, 1-(5-methylureidophenyl)-5-mercaptotetrazole was added to the blue-sensitive emulsion layers, the green-sensitive emulsion layers and the red-sensitive emulsion layers in amounts of $8.5 \times 10^{-5}$ mol, $7.7 \times 10^{-4}$ mol and $2.5 \times 10^{-4}$ mol per mol of silver halide, respectively.

Furthermore, 4-hydroxy-6-methyl-1,3,3a,7-tetrazaindene was added to the blue-sensitive emulsion layers and the green-sensitive emulsion layers in amounts of $1 \times 10^{-4}$ mol and $2 \times 10^{-4}$ mol per mol of silver halide, respectively.

For the prevention of irradiation, the following dyes were added to the emulsion layers (the amounts of coating are indicated in parentheses).

(10 mg/m$^2$)

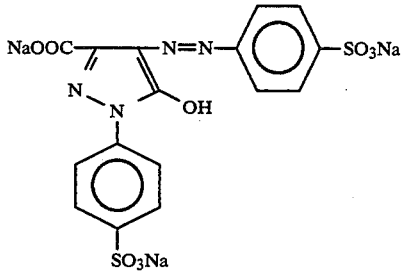

-continued

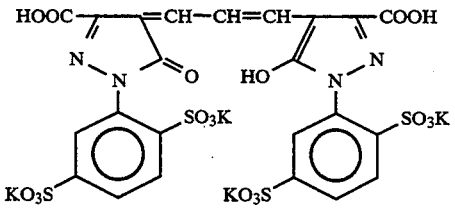

(10 mg/m²)

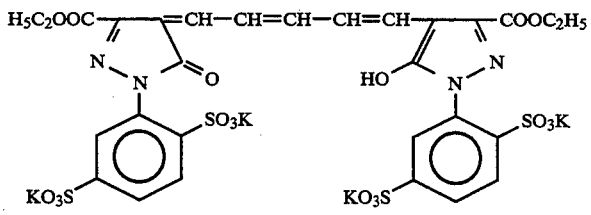

(40 mg/m²)

and

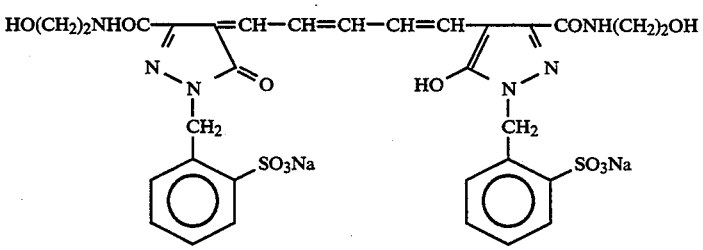

(20 mg/m²)

Layer structure

The composition for each of the layers is shown below. The numerals represent the coating amount (g/m²). For the silver halide emulsions, the numerals indicate coated weights converted to silver.

TABLE 5

| | |
|---|---|
| Support | |
| Polyethylene laminated paper [Polyethylene on the first layer side contains white pigment ($TiO_2$) and blue-tinted dye (ultramarine)] | |
| First layer (Blue-sensitive emulsion layer) | |
| Above-described silver chlorobromide emulsion A | 0.27 |
| Gelatin | 1.36 |
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| Second layer (Color mixing inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |

TABLE 6

| | |
|---|---|
| Third layer (Green-sensitive emulsion layer) | |
| Silver chlorobromide (Cubic, 1:3 mixture (molar ratio based on silver) of large grain emulsion B having an average grain size of 0.55 μm and small grain emulsion B having an average grain size of 0.39 μm. Variation coefficients of the grain size distribution were 0.10 and 0.08, respectively. Both emulsions contain 0.8 mol % of AgBr deposited locally in part of the grain surface.) | 0.13 |
| Gelatin | 1.45 |
| Magenta coupler (ExM) | 0.16 |

TABLE 6-continued

| | |
|---|---|
| Color image stabilizer (Cpd-5) | 0.15 |
| Color image stabilizer (Cpd-2) | 0.03 |
| Color image stabilizer (Cpd-6) | 0.01 |
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (Color mixing inhibiting layer) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |

TABLE 7

| | |
|---|---|
| Fifth layer (Red-sensitive emulsion layer) | |
| Silver chlorobromide emulsion (Cubic, 1:4 mixture (molar ratio based on silver) of large grain emulsion C having an average grain size of 0.50 μm and small grain emulsion C having an average grain size of 0.41 μm. Variation coefficients of the grain size distribution were 0.09 and 0.11, respectively. Both emulsions contain 0.8 mol % of AgBr deposited locally in part of the grain surface.) | 0.20 |
| Gelatin | 0.85 |
| Cyan coupler (ExC) | 0.33 |
| UV absorber (UV-2) | 0.18 |
| Color image stabilizer (Cpd-9) | 0.02 |
| Color image stabilizer (Cpd-10) | 0.02 |
| Color image stabilizer (Cpd-11) | 0.01 |
| Solvent (Solv-6) | 0.22 |
| Color image stabilizer (Cpd-8) | 0.01 |
| Color image stabilizer (Cpd-6) | 0.01 |
| Solvent (Solv-1) | 0.01 |
| Color image stabilizer (Cpd-1) | 0.33 |
| Sixth layer (UV absorbing layer) | |
| Gelatin | 0.55 |
| UV absorber (UV-1) | 0.38 |

TABLE 7-continued

| | |
|---|---|
| Color image stabilizer (Cpd-12) | 0.15 |
| Color image stabilizer (Cpd-5) | 0.02 |

TABLE 8

| Seventh layer (Protective layer) | |
|---|---|
| Gelatin | 1.13 |
| Acrylic modified copolymer of polyvinyl alcohol (Degree of modification: 17%) | 0.05 |
| Liquid paraffin | 0.02 |
| Color image stabilizer (Cpd-13) | 0.01 |

The chemical structures of the compounds used for preparing the multilayer color photographic printing papers are shown below.

(ExY) Yellow coupler

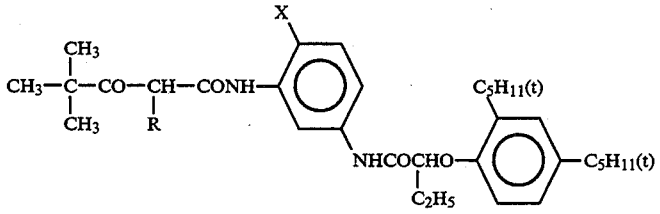

(ExM) Magenta coupler

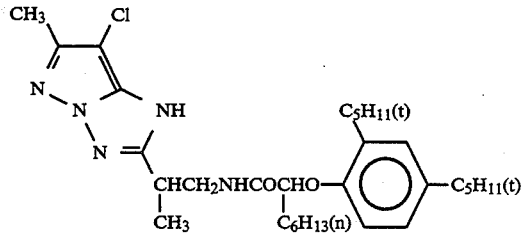

(ExC) Cyan coupler

Mixture (3:7 in molar ratio) of

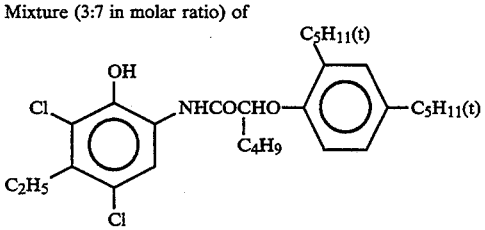

and

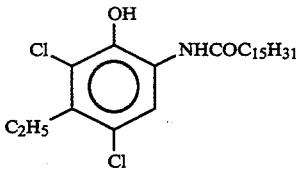

(Cpd-1) Color image stabilizer

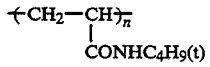

Average molecular weight: 60,000

(Cpd-2) Color image stabilizer

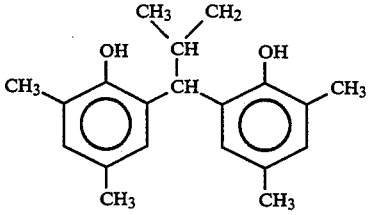

(Cpd-3) Color image stabilizer

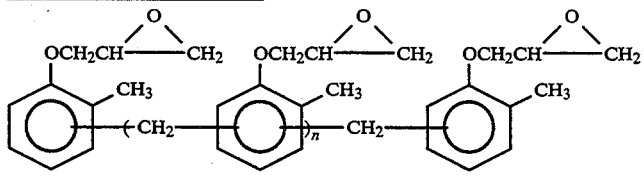

n = 7~8(average value)

-continued

Mixture (1:1 in molar ratio) of

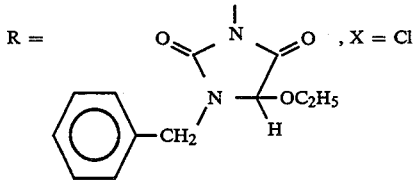

and

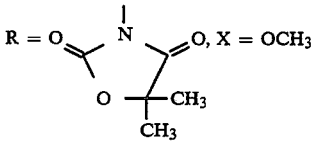

of the following formula (Cpd-4) Color mixing inhibitor

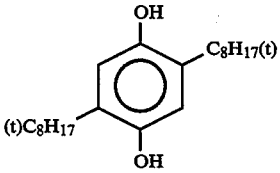

-continued (Cpd-5) Color image stabilizer

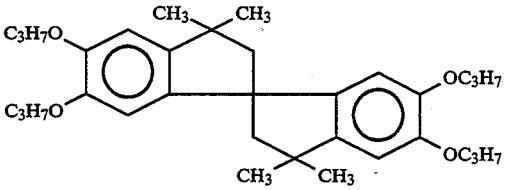

(Cpd-6) Color image stabilizer

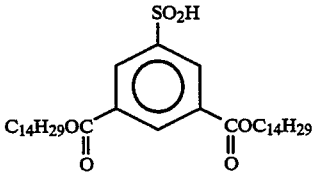

(Cpd-7) Color image stabilizer

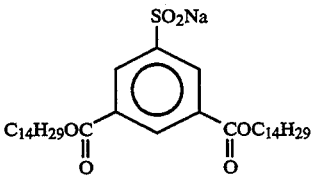

(Cpd-8) Color image stabilizer

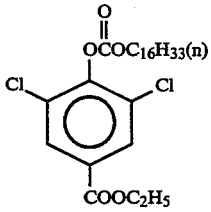

(Cpd-9) Color image stabilizer

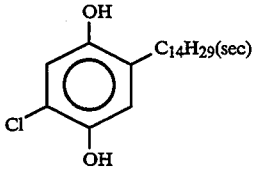

(Cpd-10) Color image stabilizer

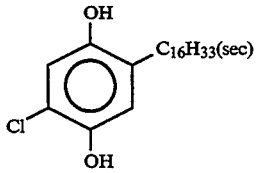

(Cpd-11) Color image stabilizer

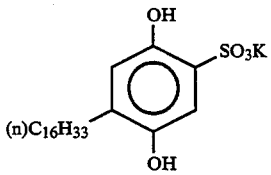

(Cpd-12) Color image stabilizer

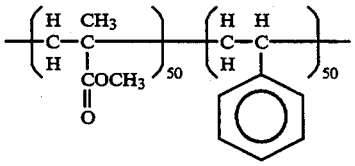

Average molecular weight: 60,000

(Cpd-13) Color image stabilizer

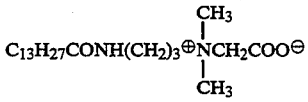

(Cpd-14) Preservative

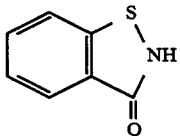

(Cpd-15) Preservative

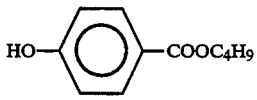

(UV-1) UV absorber

Mixture (10:5:1:5 in weight ratio) of (1)

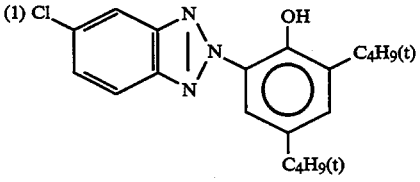

(2)

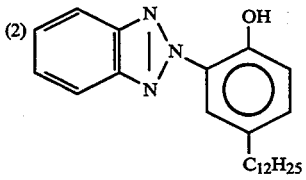

(3) 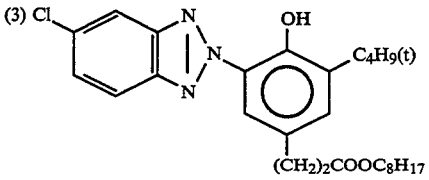

and

-continued (4) 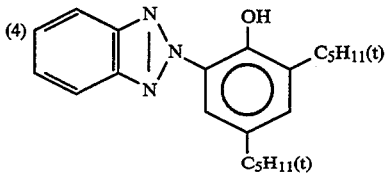

(UV-2) UV absorber

Mixture (1:2:2 in weight ratio) of (1) 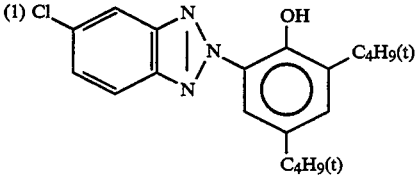

(2) 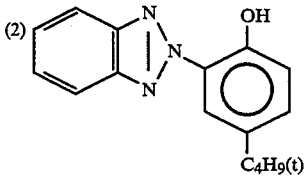

and (3) 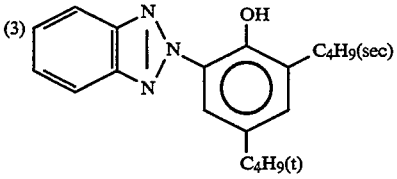

(Solv-1) Solvent

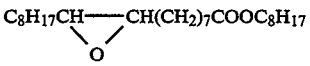

(Solv-2) Solvent

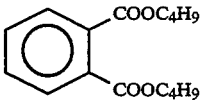

(Solv-3) Solvent

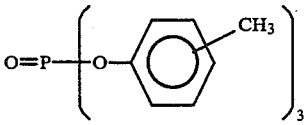

(Solv-4) Solvent

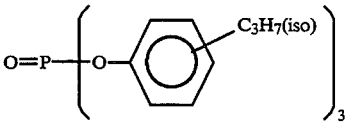

(Solv-5) Solvent

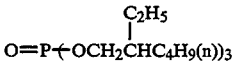

(Solv-6) Solvent

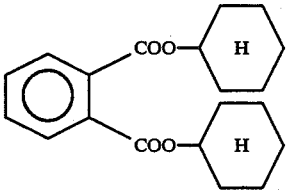

(Solv-7) Solvent

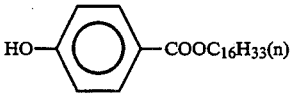

Printing papers 102–125 were prepared by following the procedure for preparing the printing paper 101 except that the color mixing inhibitor Cpd-4 contained in the second and fourth layers of the printing paper 101 and the magenta coupler ExM contained in the third layer thereof were replaced with compounds shown in Table 9 below, and compounds which are known as gradation improving agents were added to the second and fourth layers of each printing paper.

TABLE 9

| | Additives in second and fourth layers | | | Magenta | | | Remarks | |
|---|---|---|---|---|---|---|---|---|
| | Color mixing inhibiter | Gradation improving agent | Addition amount (mol %*1) | coupler in third layer | Gradation*2 | Gradation after storage | | Formula of magenta coupler |
| 101 | Cpd-4 | — | — | ExM | 1.68 | 1.63 | Comparative example | (III) |
| 102 | I-A | — | — | ↓ | 1.63 | 1.59 | ↓ | ↓ |

TABLE 9-continued

| | Additives in second and fourth layers | | | Magenta | | | Remarks | |
|---|---|---|---|---|---|---|---|---|
| | Color mixing inhibiter | Gradation improving agent | Addition amount (mol %*1) | coupler in third layer | Gradation*2 | Gradation after storage | | Formula of magenta coupler |
| 103 | I-A | II-1 | 10 | ↓ | 1.98 | 1.45 | ↓ | ↓ |
| 104 | I-B | — | — | ↓ | 1.62 | 1.61 | ↓ | ↓ |
| 105 | I-B | II-1 | 10 | ↓ | 1.94 | 1.52 | ↓ | ↓ |
| 106 | Cpd-4 | II-1 | 10 | ↓ | 2.05 | 2.01 | Present | ↓ |
| | | | | ↓ | | | invention | ↓ |
| 107 | Cpd-4 | II-7 | 10 | ↓ | 2.08 | 2.06 | ↓ | ↓ |
| 108 | I-2 | II-2 | 10 | ↓ | 2.01 | 1.93 | ↓ | ↓ |
| 109 | I-6 | II-6 | 10 | M-5 | 2.03 | 1.99 | ↓ | ↓ |
| 110 | I-9 | II-9 | 10 | ↓ | 2.07 | 2.05 | ↓ | ↓ |
| 111 | Cpd-4 | II-1 | 10 | M-4 | 2.24 | 2.22 | ↓ | (IV) ↓ |
| 112 | I-2 | II-2 | 10 | ↓ | 2.02 | 1.95 | ↓ | ↓ ↓ |
| 113 | I-12 | II-12 | 5 | ↓ | 2.10 | 2.08 | ↓ | ↓ ↓ |
| 114 | I-13 | II-15 | 10 | ↓ | 2.17 | 2.15 | ↓ | ↓ ↓ |
| 115 | I-10 | II-10 | 10 | ↓ | 2.23 | 2.23 | ↓ | ↓ ↓ |
| 116 | I-10 | II-10 | 10 | M-2 | 2.21 | 2.16 | ↓ | ↓ ↓ |
| 117 | I-10 | II-10 | 10 | M-3 | 2.18 | 2.14 | ↓ | ↓ ↓ |
| 118 | I-10 | II-10 | 10 | M-9 | 2.19 | 2.17 | ↓ | ↓ ↓ |
| 119 | I-10 | II-10 | 10 | M-7 | 2.21 | 2.13 | ↓ | ↓ ↓ |
| 120 | I-10 | II-10 | 3 | ↓ | 2.05 | 1.96 | ↓ | ↓ ↓ |
| 121 | I-10 | II-10 | 1 | ↓ | 1.84 | 1.78 | Comparative | ↓ ↓ |
| | | | | ↓ | | | example | ↓ ↓ |
| 122 | I-10 | — | — | ↓ | 1.69 | 1.63 | ↓ | ↓ ↓ |
| 123 | I-11 | II-A | 10 | ↓ | 1.95 | 1.48 | ↓ | ↓ ↓ |
| 124 | I-11 | II-B | 10 | M-A | 1.97 | 1.46 | ↓ | |
| 125 | I-11 | II-11 | 10 | ↓ | 1.65 | 1.61 | ↓ | |

*1: gradation improving agent/color mixing inhibitor (mol %)
*2: Average gradation between density Dmin + 0.1 and density Dmin + 0.6

Color mixing inhibitor (I-A)

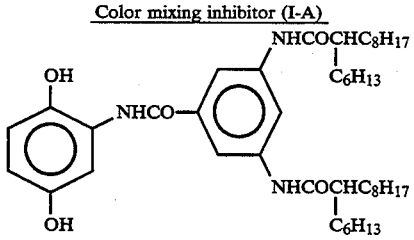

Color mixing inhibitor (I-B)

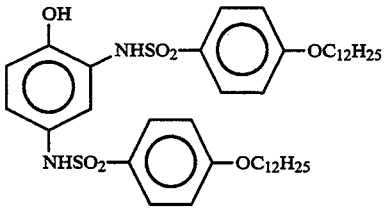

Gradation improving agent (II-A)

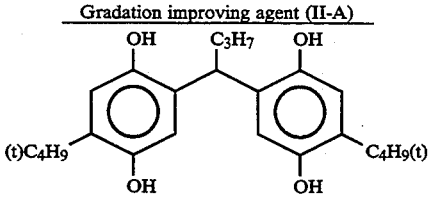

Gradation improving agent (II-B)

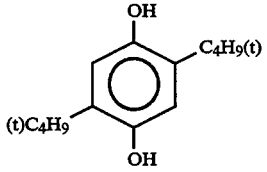

Magenta coupler (M-A)

-continued

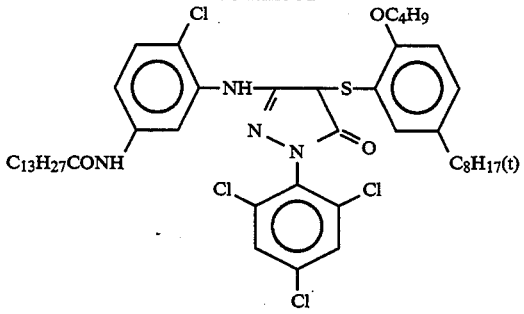

Each of the photographic printing papers thus prepared was exposed through an optical wedge.

The samples for which exposure was completed were continuously processed by a paper processing machine in accordance with the following processes and using processing solutions having the following compositions until twice the amount of the tank capacity of the color developing tank was replenished (running test).

| Step | Temperature | Time | Replenisher* | Tank capacity |
|---|---|---|---|---|
| Color development | 35° C. | 45 sec. | 161 ml | 17 liters |
| Bleach-fixing | 30–35° C. | 45 sec. | 215 ml | 17 liters |
| Rinsing (1) | 30–35° C. | 20 sec. | — | 10 liters |
| Rinsing (2) | 30–35° C. | 20 sec. | — | 10 liters |
| Rinsing (3) | 30–35° C. | 20 sec. | 350 ml | 10 liters |
| Drying | 70–80° C. | 60 sec. | | |

*: Amount of replenisher is amount per 1 $m^2$ of light-sensitive material.
(Rinsing is carried out by a 3-tank countercurrent system from tank (3) to tank (2) and from tank (2) to tank (1).)

The processing solutions employed had the following compositions respectively.

| | Tank solution | Replenisher |
|---|---|---|
| Color developing solution: | | |
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-bis(carboxymethyl)hydrazine | 4.0 g | 5.0 g |
| N,N-di(sulfoethyl)hydroxylamine.1NA | 4.0 g | 5.0 g |
| Fluorescent brightener (Whitex 4B, Sumitomo Chemical Co., Ltd.) | 1.0 g | 2.0 g |
| Water to make | 1000 ml | 1000 ml |
| pH (25° C.) | 10.05 | 10.45 |
| Bleach-fixing solution: | | |
| (Tank solution and replenisher are the same.) | | |
| Water | 400 ml | |
| Ammonium thiosulfate (700 g/liter) | 100 ml | |
| Sodium sulfite | 17 g | |
| Ammonium iron (III) ethylenediaminetetraacetate.$2H_2O$ | 55 g | |
| Disodium ethylenediaminetetraacetate.$2H_2O$ | 5 g | |
| Ammonium bromide | 40 g | |
| Water to make | 1000 ml | |
| pH (25° C.) | 6.0 | |
| Rinsing solution: | | |
| (Tank solution and replenisher are the same.) | | |
| Ion-exchanged water (calcium and magnesium ions: each 3 ppm or less) | | |

Several of the processed samples were stored for one week at 80° C. and 70% relative humidity, and were compared with the samples before storage in terms of photographic characteristics.

The photographic characteristics were evaluated with respect to gradation (average gradation from density $D_{min}+0.1$ to density $D_{min}+0.6$). The results are shown in Table 9.

From the results of Table 9, it is apparent that the light-sensitive material according to the present invention, in which the compound of formula (I) and the compound of formula (II) are used in combination with the coupler of formula (III), provide a preferable gradation and excellent preservability. Further, it was found that such effects become particularly marked when the coupler of formula (IV) was used as a magenta coupler.

When sample 101 was processed using an exhausted developer in which samples 123 and 124 had been continuously processed, the photographic characteristics differed from those in a case in which the sample was processed using a fresh developer. On the contrary, when sample 101 was processed using an exhausted developer in which samples 115 through 119 had been processed, the photographic characteristics were almost the same as those in a case in which the sample was processed using a fresh developer. From these results, it is apparent that the light-sensitive material according to the present invention only causes a slight amount of contamination of the processing solution.

EXAMPLE 2

Sample 110 used in Example 1 of JP-A-2-228652 (hereinafter this publication is referred to as H2a) was prepared. Further, the same procedure employed for preparing sample 110 in H2a was used to prepare samples 201, 202 and 203 except that Cpd-1 contained in the fifth, ninth and eleventh layers, which were all intermediate layers, of sample 110 was replaced by equimolar amounts of mixtures Mix-1, Mix-2 or Mix-3, respectively, which contain the following example compounds of the present invention. A magenta coupler (M-19) of the present invention was incorporated in the sixth, seventh and eighth layers, which were all green-sensitive emulsion layers, of each of the four types of samples. Each sample was subjected to image forming exposure, and then developed in the same manner as employed in Example 1 of H2a. Measurement of yellow fogging density of the developed samples clearly demonstrated that the fogging density of samples 201, 202 and 203 was smaller than that of sample 110 in H2a.

| | |
|---|---|
| Mix-1 | (I-10):(II-10) = 10:1 (molar ratio) |
| Mix-2 | (I-2):(II-2) = 10:1 (molar ratio) |
| Mix-3 | (I-7):(II-7) = 10:1 (molar ratio) |

Comparative compound (Cpd-1)

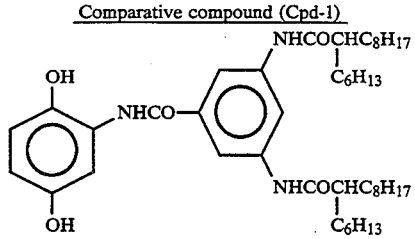

EXAMPLE 3

Sample 101 used in Example 1 of JP-A-2-90153 (hereinafter this publication is referred to as H2b) was prepared. Further, the same procedure employed for preparing sample 101 in H2b was used to prepare samples X, Y and Z except that Cpd-7 contained in the fifth, ninth and tenth layers, which were all intermediate layers, of sample 101 was replaced by equimolar amounts of mixtures Mix-1, Mix-2 or Mix-3, respectively, which were used in Example 2 of the present invention. A magenta coupler (M-19) of the present invention was incorporated in the sixth and seventh layers, which were both green-sensitive emulsion layers, of each of the four types of samples. Each sample was processed in the same manner as employed in Example 1 in H2b. As a result, it was recognized that the purity whiteness obtained by the use of samples X, Y and Z of the present invention was clearly superior to that of sample 101 in H2b.

Comparative Compound (Cpd-7)

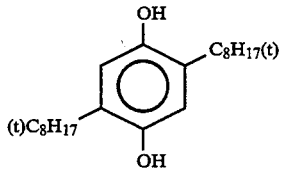

EXAMPLE 4

Sample 102 used in Example 1 of JP-A-3-154051 (hereinafter this publication is referred to as H3) was prepared. Further, the same procedure employed for preparing sample 102 in H3 was used to prepare samples 901, 902 and 903 except that Cpd-A contained in the eighth and thirteenth layers, which were both intermediate layers, of the sample 102 was replaced by equimolar amounts of mixtures Mix-1, Mix-2 or Mix-3, respectively, which were used in Example 2 of the present invention. A magenta coupler (M-20) of the present invention was incorporated in the ninth, tenth and eleventh layers, which were all green-sensitive emulsion layers, of each of the four types of samples. Each sample was processed in the same manner as employed in Example 1 in H3. As a result, it was recognized that the purity whiteness of samples 901, 902 and 903 of the present invention was clearly superior to that of sample 102 in H3.

Comparative compound (Cpd-A)

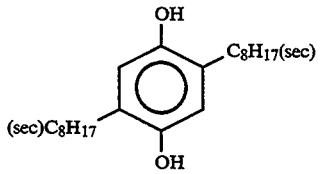

Since the silver halide color photographic light-sensitive materials according to the present invention have the above-mentioned structure, the silver halide color photographic light-sensitive materials have excellent spectral characteristics, provide improved blank white areas and gradation, maintain stable photographic performance during storage and provide reduced deterioration of processing solutions in which the materials are processed under continuous processing.

We claim:

1. A silver halide color photographic light-sensitive material comprising a support which has thereon at least one light-sensitive silver halide emulsion layer and at least one light-nonsensitive layer, wherein said light-nonsensitive layer comprises a layer which contains a compound represented by formula (I) and a compound represented by formula (II), said light-sensitive silver halide emulsion layer comprises at least one coupler represented by formula (III), and a total amount of a compound represented by formula (II) is 2 to 20 mol % of a total amount of a compound represented by formula (I):

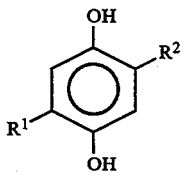

(I)

wherein $R^1$ and $R^2$ independently represent a substituted or unsubstituted alkyl group, a sum of carbon atoms of $R^1$ and $R^2$ being not less than 20 and not more than 40;

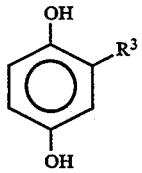

(II)

wherein $R^3$ represents a substituted or unsubstituted alkyl group having not less than 10 and not more than 20 carbon atoms;

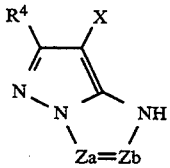

(III)

wherein Za and Zb independently represent =C($R^5$)— or =N-; $R^4$ and R5 independently represent a substituent; and X represents a hydrogen atom or a releasable group in a reaction with an oxidation product of an aromatic primary amine color developing agent.

2. The silver halide color photographic light-sensitive material as claimed in claim 1, wherein $R^1$ and $R^2$ in formula (I) both represent the same substituted or unsubstituted alkyl group.

3. The silver halide color photographic light-sensitive material as claimed in claim 1, wherein $R^1$ and $R^2$ in formula (I) both represent the same substituted or unsubstituted sec-alkyl group.

4. The silver halide color photographic light-sensitive material as claimed in claim 1, wherein $R^3$ in formula (II) represents a substituted or unsubstituted alkyl group having 12 to 20 carbon atoms.

5. The silver halide color photographic light-sensitive material as claimed in claim 1, wherein $R^3$ in formula (II) represents a substituted or unsubstituted alkyl group having 14 to 18 carbon atoms.

6. The silver halide color photographic light-sensitive material as claimed in claim 1, wherein $R^1$, $R^2$ and $R^3$ independently represent an unsubstituted alkyl group.

7. The silver halide color photographic light-sensitive material as claimed in claim 1, wherein a total amount of a compound represented by formula (II) is 2 to 15 mol % of a total amount of a compound represented by formula (I).

8. The silver halide color photographic light-sensitive material as claimed in claim 1, wherein a total amount of a compound represented by formula (II) is 4 to 12 mol % of a total amount of a compound represented by formula (I).

9. The silver halide color photographic light-sensitive material as claimed in claim 1, wherein $R^4$ and $R^5$ in formula (III) each independently represents a halogen atom, an aliphatic group, an aryl group, a heterocyclic group, a cyano group, a hydroxyl group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclicoxy group, an azo group, an acyloxy group, a carbamoyloxy group, a silyloxy group, an aryloxy carbonylamino group, an imido group, a heterocyclicthio group, a sulfinyl group, a phosphonyl group, an aryloxycarbonyl group, an acyl group or an azolyl group.

10. The silver halide color photographic light-sensitive material as claimed in claim 1, wherein the releasable group which is represented by X in formula (III) represents a halogen atom, an alkoxy group, an aryloxy group, an acyloxy group, an alkylsulfonyloxy group, an arylsulfonyloxy group, an acylamino group, an alkylsulfonamide group, an arylsulfonamide group, an alkoxycarbonyloxy group, an aryloxycarbonyloxy group, an alkylthio group, an arylthio group, a heterocyclicthio group, a carbamoylamino group, a 5-membered or 6-membered nitrogen containing heterocyclic group, an imido group or an arylazo group.

11. The silver halide color photographic light-sensitive material as claimed in claim 1, wherein said light-nonsensitive layer comprises $1\times10^{-8}$ to $1\times10^{-2}$ mol per 1 $m^2$ of a compound represented by formula (I).

12. The silver halide color photographic light-sensitive material as claimed in claim 1, wherein a coupler represented by formula (III) is a coupler represented by formula (IV):

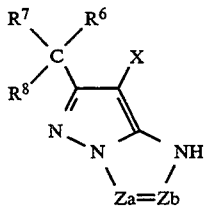

(IV)

wherein Za and Zb independently represent =C($R^5$)— or =N-, $R^5$, $R^6$, $R^7$ and $R^8$ each represents a substituent; and X represents a hydrogen atom or a releasable group in a reaction with an oxidation product of an aromatic primary amine color developing agent.

13. The silver halide color photographic light-sensitive material as claimed in claim 12, wherein $R^5$, $R^6$, $R^7$ and $R^8$ in formula (IV) each independently represents a halogen atom, an aliphatic group, an aryl group, a heterocyclic group, a cyano group, a hydroxyl group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclicoxy group, an azo group, an acyloxy group, a carbamoyloxy group, a silyloxy group, an aryloxy carbonylamino group, an imido group, a heterocyclicthio group, a sulfinyl group, a phosphonyl group, an aryloxycarbonyl group, an acyl group or an azolyl group.

14. The silver halide color photographic light-sensitive material as claimed in claim 12, wherein $R^6$, $R^7$ and $R^8$ in formula (IV) each independently represents an alkyl group.

15. The silver halide color photographic light-sensitive material as claimed in claim 14, wherein $R^6$, $R^7$ and $R^8$ in formula (IV) each independently represents a methyl group or an ethyl group.

16. The silver halide color photographic light-sensitive material as claimed in claim 12, wherein a coupler represented by formula (IV) is a coupler represented by formula (V) or (VI):

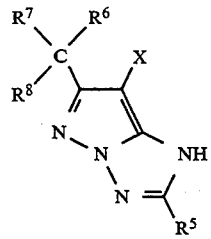

(V)

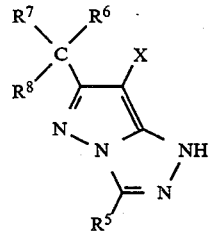

(VI)

wherein $R^5$, $R^6$, $R^7$ and $R^8$ each represents a substituent; and X represents a hydrogen atom or a releasable group in a reaction with an oxidation product of an aromatic primary amine color developing agent.

17. The silver halide color photographic light-sensitive material as claimed in claim 1, wherein a coupler represented by formula (III) is incorporated in at least one green-sensitive emulsion layer.

18. The silver halide color photographic light-sensitive material as claimed in claim 1, wherein an amount of a coupler represented by formula (III) is $1\times10^{-3}$ to 1 mol per 1 mol of silver halide in the same silver halide emulsion layer.

19. The silver halide color photographic material as claimed in claim 1, wherein said substituted alkyl group is an alkyl group that is substituted with at least one member selected from the group consisting of halogen atom, cyano group, hydroxyl group, alkoxy group, aryloxy group, alkythio group, arylthio group, amide group, alkoxycarbonyl group, alkoxycarbonyloxy group, acyl group, and sulfonyl group.

20. The silver halide color photographic material as claimed in claim 1, wherein $R^1$ is methyl.

* * * * *